US011043069B2

(12) United States Patent
Oberberger et al.

(10) Patent No.: US 11,043,069 B2
(45) Date of Patent: Jun. 22, 2021

(54) SKILLFULL REGULATED CASINO GAMES AND GAMING MACHINES CONFIGURED TO PLAYER REWARDS BASED UPON OBSERVED SKILL LEVEL

(71) Applicant: SYNERGY BLUE, LLC, Palm Desert, CA (US)

(72) Inventors: Michael Oberberger, Spring Hill, TN (US); Michael Low, Henderson, NV (US)

(73) Assignee: SYNERGY BLUE LLC, Las Vegas, NV (US)

( * ) Notice: Subject to any disclaimer, the term of this patent is extended or adjusted under 35 U.S.C. 154(b) by 203 days.

(21) Appl. No.: 16/153,798

(22) Filed: Oct. 7, 2018

(65) Prior Publication Data

US 2020/0111305 A1 Apr. 9, 2020

(51) Int. Cl.
*G07F 17/32* (2006.01)

(52) U.S. Cl.
CPC ..... *G07F 17/3244* (2013.01); *G07F 17/3213* (2013.01); *G07F 17/3295* (2013.01)

(58) Field of Classification Search
CPC ..... G07F 17/3244; G07F 17/3213; G07F 17/3295
See application file for complete search history.

(56) References Cited

U.S. PATENT DOCUMENTS 6,053,813 A 4/2000 Mathis
6,308,565 B1 10/2001 French et al.
(Continued)

FOREIGN PATENT DOCUMENTS

WO 2017079701 A1 5/2017

OTHER PUBLICATIONS

U.S. Appl. No. 15/719,342, Oberberger, filed Sep. 28, 2017.
(Continued)

*Primary Examiner* — Steve Rowland
(74) *Attorney, Agent, or Firm* — Young Law Firm, PC

(57) ABSTRACT

A computer-implemented method of operating a regulated gaming machine may comprise accepting funds, in the regulated gaming machine, from a player and correspondingly establishing player game credits enabling the player to play a wager-based skillful game and enabling game play and receiving player input from a user interface of the regulated gaming machine as the player interacts with in-game assets. The gaming machine may then determine whether sufficient player input has been received and game play has occurred to determine a skill level of the player. When sufficient game play has occurred, the skill level of the player may be determined, and the determined skill level may be compared to at least a first predetermined threshold skill level and a second predetermined threshold skill level. When the determined skill level is at least as great as the first predetermined threshold skill level, a first animation may be displayed, and a first change may be made to rewards due to the player for achieving in-game objectives, for at least a portion of remaining game play. When the determined skill level is at least as great as the second predetermined threshold skill level, a second animation may be displayed, a second change may be made to rewards due to the player for achieving in-game objectives for at least a portion of remaining game play.

28 Claims, 15 Drawing Sheets

(56) References Cited

U.S. PATENT DOCUMENTS 8,292,720 B2 10/2012 Davis et al.
8,475,266 B2 7/2013 Arnone et al.
2003/0069057 A1* 4/2003 DeFrees-Parrott ..... G07F 17/32 463/16
2003/0119579 A1 6/2003 Walker et al.
2005/0059446 A1 3/2005 Kaminkow
2005/0282624 A1 12/2005 Kane
2006/0052160 A1 3/2006 Saffari et al.
2006/0205474 A1* 9/2006 Bansemer ..... A63F 9/0291 463/16
2006/0293103 A1 12/2006 Mendelsohn
2007/0066403 A1 3/2007 Konkwright
2007/0129133 A1 6/2007 Bansemer et al.
2007/0259713 A1 11/2007 Fiden et al.
2007/0293330 A1 12/2007 Garrison et al.
2008/0113781 A1 5/2008 Soltys et al.
2008/0153570 A1 6/2008 Esses et al.
2008/0167118 A1 7/2008 Kroeckel et al.
2008/0234021 A1 9/2008 Palmer et al.
2008/0287184 A1* 11/2008 Boesen ..... G07F 17/32 463/25
2009/0011824 A1 1/2009 Englman et al.
2009/0036202 A1 2/2009 Baerlocher et al.
2009/0048010 A1 2/2009 Kroeckel et al.
2009/0061991 A1* 3/2009 Popovich ..... G07F 17/32 463/25
2009/0061997 A1 3/2009 Popovich et al.
2009/0061998 A1 3/2009 Popovich et al.
2009/0104956 A1 4/2009 Kay et al.
2009/0131158 A1 5/2009 Brunet De Courssou
2009/0298573 A1* 12/2009 Bramble ..... G07F 17/32 463/20
2010/0093444 A1 4/2010 Biggar et al.
2010/0120502 A1 5/2010 Oberberger
2010/0240444 A1 9/2010 Friedman et al.
2011/0190066 A1 8/2011 Barclay et al.
2011/0212766 A1* 9/2011 Bowers ..... G07F 17/32 463/25
2011/0263312 A1* 10/2011 De Waal ..... A63F 7/02 463/20
2011/0294561 A1* 12/2011 Shaw ..... G07F 17/32 463/20
2012/0142409 A1 6/2012 Kelly et al.
2012/0157186 A1 6/2012 Chim
2013/0095900 A1* 4/2013 Mitelman ..... G07F 17/32 463/7
2013/0172059 A1 7/2013 Nicely
2013/0190074 A1 7/2013 Arnone et al.
2013/0217472 A1 8/2013 Kitamura et al.
2013/0244765 A1 9/2013 Arnone et al.
2013/0281171 A1 10/2013 Ramsour et al.
2013/0296030 A1 11/2013 Arnone et al.
2013/0316798 A1 11/2013 Arnone et al.
2014/0135103 A1 5/2014 Arnone et al.
2014/0235330 A1 8/2014 Arnone et al.
2014/0302898 A1 10/2014 Vann
2015/0011290 A1* 1/2015 Galansky ..... G07F 17/34 463/20
2015/0024829 A1 1/2015 Arnone et al.
2015/0243130 A1 8/2015 Arnone et al.
2015/0254931 A1 9/2015 Arnone et al.
2015/0348361 A1 12/2015 Adiraju
2016/0019751 A1 1/2016 Arnone et al.
2016/0027260 A1 1/2016 Pierce et al.
2016/0104353 A1 4/2016 Arnone et al.
2016/0125697 A1 5/2016 Oberberger
2016/0171827 A1 6/2016 Washington et al.
2016/0171835 A1 6/2016 Washington et al.
2016/0232747 A1 8/2016 Arnone et al.
2016/0232755 A1 8/2016 Collette et al.
2016/0292969 A1 10/2016 Dupuis et al.
2016/0379444 A1 12/2016 LeMay et al.
2017/0084124 A1 3/2017 Brunet De Courssou
2017/0084129 A1 3/2017 Baerlocher et al.
2017/0124812 A1 4/2017 Washington et al.
2017/0169657 A1 6/2017 Keilwert et al.
2017/0186280 A1 6/2017 Arnone et al.
2017/0236382 A1 8/2017 Colvin et al.
2017/0256138 A1 9/2017 Arnone et al.
2017/0287270 A1 10/2017 Arnone et al.
2017/0323524 A1 11/2017 Washington et al.
2017/0330420 A1 11/2017 Merati
2017/0345260 A1 11/2017 Strause et al.
2018/0012454 A1 1/2018 Thirumaleshwar
2018/0021671 A1 1/2018 Liesenfelt et al.
2018/0033248 A1 2/2018 LeMay et al.
2018/0047253 A1* 2/2018 Vann ..... G07F 17/3262
2018/0068529 A1* 3/2018 Delekta ..... G07F 17/3209
2018/0075707 A1 3/2018 Hirai et al.
2018/0082545 A1 3/2018 Winters et al.
2018/0089960 A1 3/2018 Caputo et al.
2018/0261044 A1 9/2018 Arnone et al.

OTHER PUBLICATIONS

U.S. Appl. No. 15/719,358, Oberberger, filed Sep. 28, 2017.
U.S. Appl. No. 15/981,038, Oberberger, filed May 16, 2018.
U.S. Appl. No. 15/920,109, Oberberger, filed Mar. 13, 2018.
U.S. Appl. No. 15/962,950, Oberberger, filed Apr. 25, 2018.
U.S. Appl. No. 15/920,272, Oberberger, filed Mar. 13, 2018.
U.S. Appl. No. 15/920,742, Oberberger, filed Mar. 14, 2018.
U.S. Appl. No. 15/920,831, Oberberger, filed Mar. 14, 2018.
U.S. Appl. No. 15/922,171, Oberberger, filed Mar. 15, 2018.
U.S. Appl. No. 15/928,283, Oberberger, filed Mar. 22, 2018.
U.S. Appl. No. 16/153,784, Oberberger, filed Oct. 7, 2018.
U.S. Appl. No. 16/153,798, Oberberger, filed Oct. 7, 2018.
U.S. Appl. No. 16/153,795, Oberberger, filed Oct. 7, 2018.
U.S. Appl. No. 16/154,463, Oberberger, filed Oct. 8, 2018.
U.S. Appl. No. 16/153,809, Oberberger, filed Oct. 7, 2018.
U.S. Appl. No. 16/153,813, Oberberger, filed Oct. 7, 2018.
U.S. Appl. No. 16/153,782, Oberberger, filed Oct. 7, 2018.
U.S. Appl. No. 16/154,407, Oberberger, filed Oct. 8, 2018.
International Search Report and Written Opinion dated Sep. 19, 2018 in PCT/US2018/041767.
International Search Report and Written Opinion dated Sep. 19, 2018 in PCT/US2018/041763.
International Search Report and Written Opinion dated Sep. 26, 2018 in PCT/US2018/041772.
International Search Report and Written Opinion dated Sep. 26, 2018 in PCT/US2018/041799.
International Search Report and Written Opinion dated Oct. 2, 2018 in PCT/US2018/041810.
International Search Report and Written Opinion dated Oct. 2, 2018 in PCT/US2018/041817.
International Search Report and Written Opinion dated Oct. 3, 2018 dated PCT/US2018/041829.
International Search Report and Written Opinion dated Oct. 3, 2018 in PCT/US2018/041833.
International Search Report and Written Opinion dated Oct. 2, 2018 in PCT/US2018/041836.
International Search Report and Written Opinion dated Nov. 25, 2019 in PCT/US2019/052311.

* cited by examiner

SKILLFULL REGULATED CASINO GAMES AND GAMING MACHINES CONFIGURED TO PLAYER REWARDS BASED UPON OBSERVED SKILL LEVEL

BACKGROUND

Embodiments shown and described herein are directed to methods, devices systems, and computer program products for determining rewards due to a player playing a regulated casino gaming machine.

BRIEF DESCRIPTION OF THE DRAWINGS

FIG. 15 also shows exemplary tangible, non-transitory computer-readable media having data stored thereon representing sequences of instructions which, when executed by the regulated gaming computing device, cause the regulated gaming computing device to determine rewards due to a player playing a wager-based game according to embodiments.

DETAILED DESCRIPTION

Figure 1:
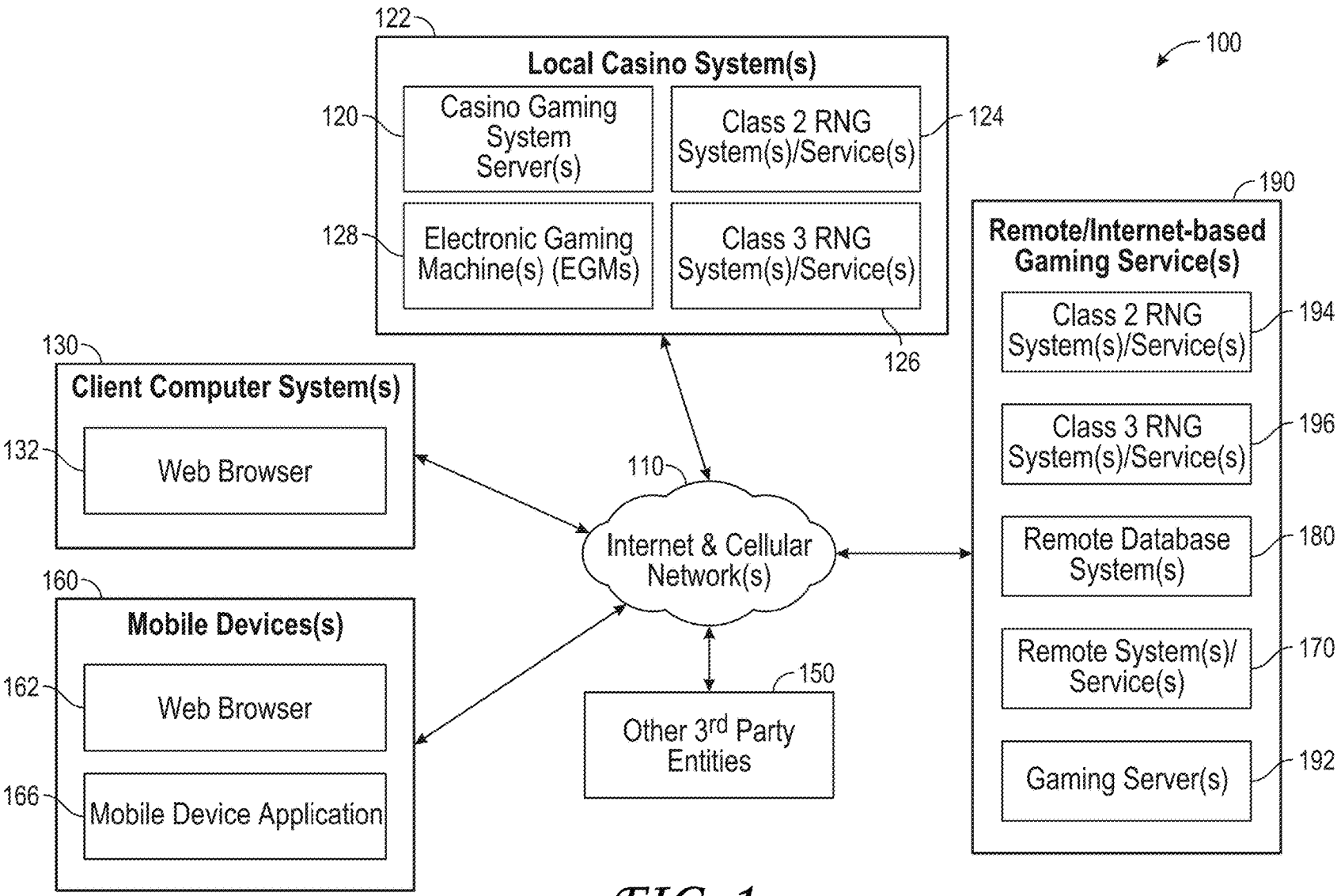
FIG. 1 illustrates a block diagram of a gaming network suitable for implementing embodiments.

Veteran gamblers (e.g., older gambler demographic age 50+) have been accustomed to a standard set of video gaming symbols (e.g., A, J, K, Q from playing cards) which, for example, may be accompanied with a multitude of additional themed symbols (e.g., fruits, animals, fantasy creatures, media personas, etc.) presented on a series of wheels or drums. Newer technology has made possible the use of digital display screens that present the reels and symbols in a digital format. Such existing slot machine technology, however, is dated and may be unappealing to younger players. Indeed, younger gamblers (e.g., also referred to as "gamers"), on the other hand, are accustomed to home gaming consoles (Nintendo, XBOX, PlayStation and the like) that provide them with exquisitely-rendered immersive 2D & 3D game environments with which they can interact. These gamers, who are used to fast paced, energetic, and visually stunning games, feel that the display method of the traditional slot machines are unappealing, which leads to decreased revenue for casino operators.

It is desirable, therefore, to offer hybrid arcade/wager-based games or gambling arcade games that provide hybrid arcade-style, wager-based gaming techniques, which find a ready demographic in younger gamers. However, one significant obstacle regarding such hybrid arcade-style, wager-based gaming techniques is that they often rely on complex back end solutions that require lengthy and costly processes of regulatory review and approvals in many different gaming jurisdictions.

One possible workaround to this significant obstacle is to configure/design a hybrid arcade-style, wager-based game such that it is compliant with currently approved wager-based gaming regulatory standards such as, for example, the well-known GLI standards, which have already been approved in various gaming jurisdictions. One example of a GLI standard is the GLI-11 standard version 3.0, Published Sep. 21, 2016 by Gaming Laboratories International, LLC, which is incorporated herein by reference.

For example, in one embodiment, a hybrid arcade-style, wager-based game may be configured to provide an arcade-style gaming interface which enables a player to participate in an arcade-style game at the wager-based gaming machine. One or more events and/or activities performed by the player (e.g., during play of the arcade-style game) may automatically trigger a random number generator (RNG)-based wager that is compliant with applicable gaming standards, rules and regulations. Because such wager-based activities comply with currently existing GLI standard(s) (and/or other national, regional, local gaming rules and regulations), such hybrid arcade-style, wager-based games may not require additional regulatory approval for deployment in casino venues.

In one embodiment, a hybrid arcade-style, wager-based game may be created by combining a new and different visual game representation with a new and different method of player interaction. The hybrid arcade-style, wager-based game may be configured to provide a perceptually stimulating experience using a wide variety of human interface devices (HID), based on the theme/style of the gambling game at hand. For example, some games may utilize a gun controller for first person shooter games, or steering wheels, accelerator and brake pedals for driving games. These and other types of games and interactions may be adapted for hybrid arcade/wager-based gaming.

For example, the format of the hybrid arcade-style, wager-based game may also focus on other types of video and/or arcade-style games such as, for example, non-linear (e.g., open world) type video and/or arcade-style games such as, for example, Grand Theft Auto, linear type video and/or arcade-style games such as, for example, Half-Life, massively multiplayer online "MMO" type video and/or arcade-style games such as, for example, World of Warcraft, role-playing game "RPG" type video and/or arcade-style games such as, for example, Final Fantasy, and/or others, Such games may feature a player character that may be moved through the game world via player input, (e.g., HID), which allows for an increased sense of excitement through gameplay by providing a multitude of player-choice possibilities through a wide-array of path directions.

In some embodiments, the format of the hybrid arcade-style, wager-based game may facilitate a gameplay environment in which multiplayer functionality takes place. The multiplayer gameplay may have multiple "enrollment" aspects in which one, for example, particular player could be on location at a casino playing a hybrid arcade/wager-based game, while another (e.g., different) player could be at a different location, concurrently participating in the same hybrid arcade/wager-based game, but without participating in any wagering aspect/portions of hybrid arcade/wager-based game. A non-wagering game such as this is commonly known as a "free to play" game, which the player is allowed to download and install on their own devices. The player may then progress through the game (e.g., which is very similar to its the wager-based counter-part) without taking part in wager-based events. Gaming situations such as these may promote a "clicks to bricks" outcome where a casino property promotes their games to home users and invites them to develop familiarity and expertise on non-wagering versions of the games. Later, those same home players may be invited to visit the casinos to play the hybrid arcade/wager version of the games.

In some embodiments, different players concurrently participating in the same hybrid arcade/wager-based game may each separately configure his/her respective wagering parameters/amounts, which may be different from the wagering parameters/amounts configured by other game player-participants.

FIG. 1 illustrates a block diagram of an embodiment of a hybrid arcade/wager-based gaming system 100 which may be implemented via a computer network. At least a portion of the various functions, actions, operations, and activities performed by one or more component(s) of the hybrid arcade/wager-based gaming system may be initiated in response to detection of one or more conditions, events, and/or other criteria satisfying one or more different types of minimum threshold criteria. According to embodiments, at least a portion of the various types of functions, operations, actions, and/or other features provided by the hybrid arcade/wager-based gaming system may be implemented at one or more client systems(s), at one or more system server(s), and/or combinations thereof. According to different embodiments, the present hybrid arcade/wager-based gaming system 100 may be implemented in hardware and/or combinations of hardware and software.

According to one embodiment, a hybrid arcade/wager-based gaming system 100 may include local casino system(s) 122, client computer systems 130, mobile devices 160 and remote/Internet-based gaming services 190 and other 3$^{rd}$ party entities 150, coupled to a computer/communication network 110. The local casino system(s) 122 may include local casino gaming system server(s) 120. The local casino system(s) 122 may also include and class 2 RNG system(s)/service(s) 124. The Class 2 RNG system(s)/service(s) 124 may be configured to dynamically generate and/or provide Class 2 gaming type RNG outcomes to be used by hybrid arcade/wager-based Gaming devices as "predetermined" RNG outcome(s). Class 3 RNG system(s)/service(s) 126 may also be provided to dynamically generate and provide Class 3 gaming "predetermined" RNG outcome(s). Local casino system(s) 122 may also include electronic gaming machine(s) (EGMs) 128 that may be configured as described herein below.

Client computer system(s) 130 may also be operable to couple to the network 110 and implement various types of functions, operations, actions, and/or other features such as those described or referenced herein via, for example, a web browser 132. Similarly, mobile computing devices 160 (e.g., mobile phones, tablets and the like) may be configured to access the network 110 and to use a mobile web browser 162 and/or one or more mobile applications (apps) 166 to implement some or all of the functionality described herein. Third party entities 150 may also be configured to carry out some or all of the functionality described herein via the network 110.

Remote/Internet-based gaming service(s) 190 may also be coupled to network 110 and may comprise class 2 RNG system(s)/service(s) 194 as described relative to reference numeral 124, class 3 RNG system(s)/service(s) 196 as described relative to reference numeral 126, and remote database system(s) 180. Remote system(s)/service(s) 170 may be provided, which may include, for example, content provider servers/services, media streaming servers/services, database storage/access/query servers/services, financial transaction servers/services, payment gateway servers/services, electronic commerce servers/services, event management/scheduling servers/services and/or other services as needed. Remote/Internet-based gaming service(s) 190 may also include gaming servers 192.

According to embodiments, multiple instances or threads of hybrid arcade/wager-based gaming may be concurrently implemented and/or initiated via the use of one or more processors and/or other combinations of hardware and/or hardware and software. Embodiments may access and/or utilize information from one or more associated databases via communication with one or more local and/or remote memory devices.

According to different embodiments, various different types of encryption/decryption techniques may be used to facilitate secure communications over the network 110 and/or via other communication channels. For example, such encryption may utilize random number generators, SHA-1 (e.g., Secured Hashing Algorithm), MD2, MD5, DES (e.g., Digital Encryption Standard), 3DES (e.g., Triple DES), RC4 (e.g., Rivest Cipher), ARC4 (e.g., related to RC4), TKIP (e.g., Temporal Key Integrity Protocol, uses RC4), AES (e.g., Advanced Encryption Standard), RSA, DSA, DH, NTRU, and ECC (e.g., elliptic curve cryptography), PKA (e.g., Private Key Authentication), Device-Unique Secret Key and other cryptographic key data, SSL and/or others. Other security features may include use of well-known hardware-based and/or software-based security components, and/or any other known or yet to be devised security and/or hardware and encryption/decryption processes implemented in hardware and/or software.

Embodiments of hybrid arcade/wager-based gaming described herein may be implemented in hardware and/or a combination of both hardware and software. Possible implementations include in an operating system kernel, in a separate user process, in a library package bound into network applications, on a specially constructed machine, or on a network interface card. In a specific embodiment, various aspects described herein may be implemented in software such as an operating system or in an application running on an operating system.

Alternatively, hardware and/or software embodiments of present hybrid arcade/wager-based gaming techniques described herein may be implemented on a general-purpose programmable computer selectively activated or reconfigured by a computer program stored in memory. Such programmable machine may include, for example, mobile or handheld computing systems, PDA, smart phones, notebook computers, tablets, netbooks, desktop computing systems, system servers, cloud computing systems, network devices, etc.

Figure 2:
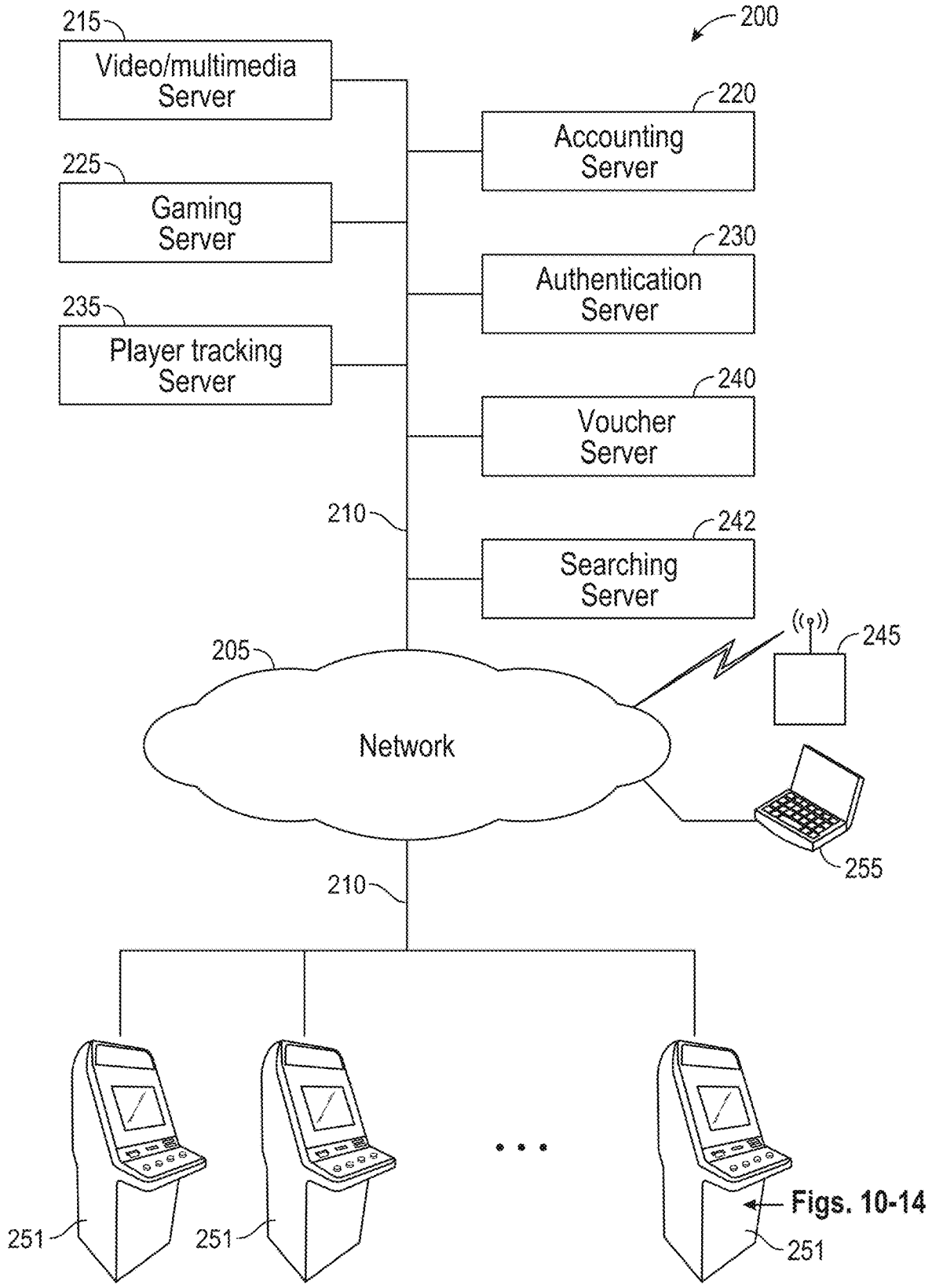
FIG. 2 shows a block diagram of an electronic gaming system according to one embodiment.

FIG. 2 shows an example block diagram of an electronic gaming system 200 according to one embodiment. As shown, electronic gaming system 200 may include electronic gaming devices (EGD) 251 (e.g., electronic gaming terminals, electronic gaming machines, wager-based video gaming machines, etc.), which may be coupled to network 205 via a network link 210. Network 205 may include the internet and/or a private network. One or more video streams may be received at video/multimedia server 215 from EGDs 251. Video/multimedia server 215 may also send one or more video streams to mobile devices 245, 255, EGDs 251, and/or other remote electronic devices. Video/multimedia server 215 may send these video streams via network link 210 and network 205.

Electronic gaming system 200 may include an accounting/transaction server 220, a gaming server 225, an authentication server 230, a player tracking server 235, a voucher server 240, and a searching server 242. The accounting/transaction server 220 may compile, track, store, and/or monitor cash flows, voucher transactions, winning vouchers, losing vouchers, and/or other transaction data for the casino operator and for the players. Transaction data may include the number of wagers, the size of these wagers, the date and time for these wagers, the identity of the players making these wagers, and the frequency of the wagers. Accounting/transaction server 220 may also generate tax information relating to these wagers, generate profit/loss and/or other reports for predetermined gaming options, contingent gaming options, predetermined betting structures, and/or outcome categories. Gaming server 225 may generate gaming options based on predetermined betting structures and/or outcome categories. These gaming options may be predetermined gaming options, contingent gaming options, and/or any other gaming option disclosed herein. The authentication server 230 may determine the validity of vouchers, players' identity, and/or an outcome for a gaming event. The player tracking server 235 may track a player's betting activity, a player's preferences such as the player's preferred language, drinks, font, sound level, and the like. Based on data obtained by player tracking server 235, a player may be eligible for gaming rewards (e.g., free play), promotions, and/or other awards (e.g., complimentary food, drinks, lodging, concerts, etc.). Voucher server 240 may generate a voucher, which may include data relating to gaming options. The generated vouchers may be physical (e.g., paper) or digital.

Searching server 242 may implement a search on one or more gaming devices to obtain gaming data. Searching server 242 may implement a messaging function, which may transmit a message to a third party (e.g., a player) relating to a search, a search status update, a game status update, a wager status update, a confirmation of a wager, a confirmation of a money transfer, and/or any other data relating to the player's account. The message can take the form of a text display on the gaming device, a pop-up window, a text message, an email, a voice message, a video message and the like. Searching server 242 may implement a wagering function, which may be an automatic wagering mechanism. These functions of searching server 242 may be integrated into one or more servers. Searching server 242 may be configured to, for example, determine which games paid out the most money during a time period, which games kept the most money from players during a time period, which games are most popular (e.g., top games), which games are least popular, which games have the most amount of money wager during a period, which games have the highest wager volume, which games are more volatile (e.g., volatility, or deviation from the statistical norms, of wager volume, wager amount, pay out, etc.) during a time period, and the like. Search may also be associated with location queries, time queries, and/or people queries.

According to embodiments, the gaming network 300 may include a display system server(s) 304 configured manage content (e.g., graphics, images, text, video fees, etc.) to be displayed and/or presented at one or more EGDs, dealer displays, administrator displays, etc. One or more EGD multimedia system server(s) 305 may be provided and coupled to network 310 and configured to manage content (e.g., graphics, images, text, video fees, audio feeds, etc.), which, for example, is to be streamed or provided to one or more EGDs (e.g., or to one or more groups of EGDs). One or more messaging system server(s) 306 may be provided and coupled to network 310 and configured for the management of messaging and/or other communications among and between the various systems, components, devices, EGDs, players, dealers, and administrators of the gaming network. mobile system server(s) 308 may manage communications and/or data exchanged with various types of mobile devices such as player-managed mobile devices (e.g., smart phones, PDAs, tablets, mobile computers), casino-managed mobile devices (e.g., mobile gaming devices). financial system server(s) 312 may be configured to track, manage, report and store financial data and financial transactions relating to one or more hybrid arcade/wager-based game sessions. According to one embodiment, a player tracking system server 314 may include at least one database that tracks each player's hands, wins/losses, bet amounts, player preferences, etc., in the network. In one implementation, the presenting and/or awarding of promotions, bonuses, rewards, achievements, etc., may be based on a player's play patterns, time, games selected, bet amount for each game type, etc. A player tracking system server may also help establish a player's preferences, which assists the casino in their promotional efforts to: award player comps (e.g., loyalty points); decide which promotion(s) are appropriate; generate bonuses and the like. Data tracking & analysis system(s) 318 may be configured to manage and analyze game data. In one embodiment, the data tracking & analysis system(s) may be configured to aggregate multisite hybrid arcade/wager-based gaming trends, local wins and jackpots.

Gaming system server(s) 322, 324 may each be dedicated to one or more specifically designated type(s) of game(s). Each game server may include game logic to host one of more virtual hybrid arcade/wager-based game sessions. At least some game server(s) may also be configured to track of the game accounting (e.g., money in, money out) for a virtual hybrid arcade/wager-based game being played, and/or for updating the financial system servers 312 at the end of each game. The game server(s) 322, 324 may also configured to generate the EGD graphics primitives (e.g., game virtual objects and game states), and may further be operable to update EGDs when a game state change (e.g., new card dealt, player upped the ante, player folds/busts, etc.) is detected. Jurisdictional/regulatory monitoring & enforcement system(s) 350 may be configured to handle tracking, monitoring, reporting, and enforcement of specific regulatory requirements relating to wager-based gameplay activities in one or more jurisdictions.

Authentication & validation system(s) 352 may be configured to determine and/or authenticate the identity of the current player at a given EGD. For example, in one embodiment, the current player may be required to perform a log in process at the EGD in order to access one or more features. Alternatively, the EGD may be adapted to automatically determine the identity of the current player based upon one or more external signals such as, for example, scanning of a barcode of a player tracking card, an RFID tag or badge worn by the current player which provides a wireless signal to the EGD for determining the identity of the current player. In at least one implementation, various security features may be incorporated into the EGD to prevent unauthorized players from engaging in certain types of activities at the EGD. In some embodiments, the authentication & validation system(s) 352 may be configured to authenticate and/or validate various types of hardware and/or software components, such as, for example, hardware/software components residing at a remote EGDs, game play information, wager information, player information and/or identity, etc.

Figure 3:
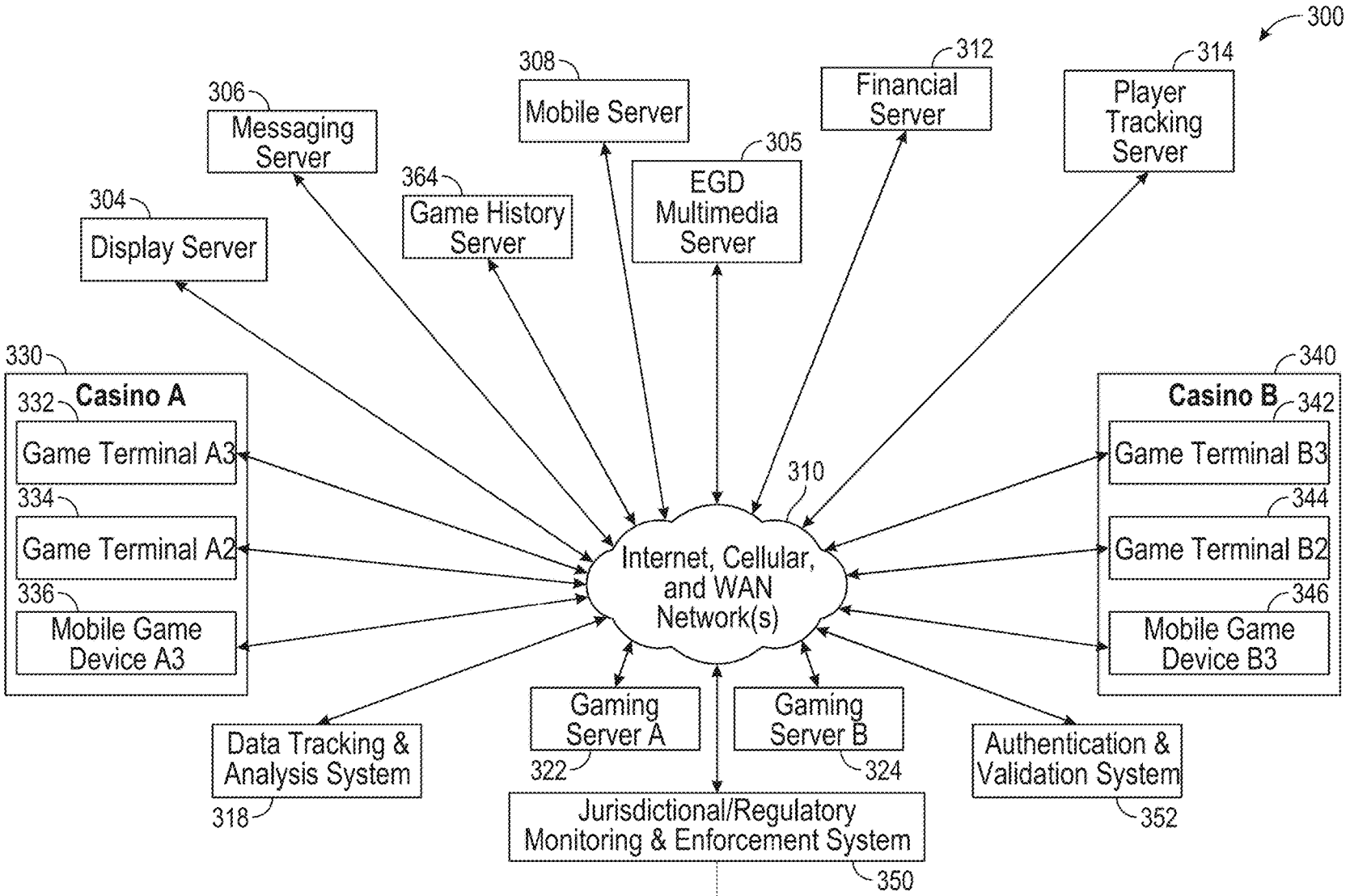
FIG. 3 illustrates a network diagram of gaming network that may be configured to implement embodiments described herein.

Casino venues, shown in FIG. 3 as Casino A 330 and Casino B 340, may correspond to a real-world, physical casino located at a particular geographic location. In some embodiments, a portion of the multiple different casino venues may be affiliated with one another (e.g., Harrah's Las Vegas, Harrah's London). In other embodiments, at least a portion of the multiple different casino venues do not share any affiliation with each other.

EGDs 332, 334, 336, 342, 344, 346 may be configured to enable players to participate in game sessions according to embodiments. Different EGDs may be physically located in one or more different casino venues, and may be connected via a communication network such as shown at 310 in FIG. 3, which may include Internet, Cellular, and WAN Network(s). In some embodiments, EGDs may be implemented as stationary machines. In some embodiments, at least some EGDs may be implemented using mobile devices (e.g., tablets, smartphones, laptops, PC's, and the like).

Game history server(s) 364 may be provided. Game history servers 364 may be configured to track game types and game play history for hybrid arcade/wager-based games. In some embodiments, a game history server may also assist the casino manager in case of disputes between players and the casino by, for example, providing the ability to "replay" (e.g., by virtually recreating the game events) the game in dispute, step by step, based on previously stored game states. Remote database system(s) may be coupled to network 310 and selectively accessible and may be configured to store and provide access to various types of information and data described herein. Remote system server(s)/service(s) may be provided, and configured to provide, for example, content provider servers/services media streaming servers/services database storage/access/query servers/services, financial transaction servers/services, payment gateway servers/services, electronic commerce servers/services, event management/scheduling servers/services and/or other services. Mobile Game Device(s) 336, 346 may be configured to provide the services described below relative to FIG. 6.

According to specific embodiments, a variety of different game states may be used to characterize the state of current and/or past events which are occurring (e.g., or have occurred) at a given EGD. For example, in one embodiment, at any given time in a game, a valid current game state may be used to characterize the state of game play (e.g., and/or other related events, such as, for example, mode of operation of the EGD, etc.) at that particular time. In at least one embodiment, multiple different states may be used to characterize different states or events which occur at the EGD at any given time. In one embodiment, when faced with ambiguity of game state, a single state embodiment forces a decision such that one valid current game state is chosen. In a multiple state embodiment, multiple possible game states may exist simultaneously at any given time in a game, and at the end of the game or at any point in the middle of the game, the EGD may analyze the different game states and select one of them based on certain criteria. Thus, for example, when faced with ambiguity of game state, the multiple state embodiment(s) allow all potential game states to exist and move forward, thus deferring the decision of choosing one game state to a later point in the game. The multiple game state embodiment(s) may also be more effective in handling ambiguous data or game state scenarios.

A variety of different entities may be used (e.g., either singly or in combination) to track the progress of game states which occur at a given gaming EGD. Examples of such entities may include a master controller system, display system, gaming system, local game tracking component(s), remote game tracking component(s), etc. Examples of various game tracking components may include, but are not limited to: automated sensors, manually operated sensors, video cameras, intelligent playing card shoes, RFID readers/writers, RFID tagged chips, objects displaying machine readable code/patterns, etc.

Local game tracking components at the EGD may be operable to automatically monitor game play activities at the EGD, and/or to automatically identify key events which may trigger a transition of game state from one state to another as a game progresses. Depending upon the type of game being played at the gaming table, examples of possible key events may include the start of a new gaming session; the end of a current gaming session; the start of a virtual slot wheel spin; a game start event; a game end event; the detection of an event that triggers the initiation of wager-based event (e.g., killing a zombie, carrying out a predetermined action upon encountering a Wagering Opportunity, and the like); the detection of event that triggers the end of a wager-based event; the detection of event that triggers the initiation or end of a randomized game play event; an initial wager period start or end; a subsequent wager period start or end; or a payout period start or end.

Figure 4:
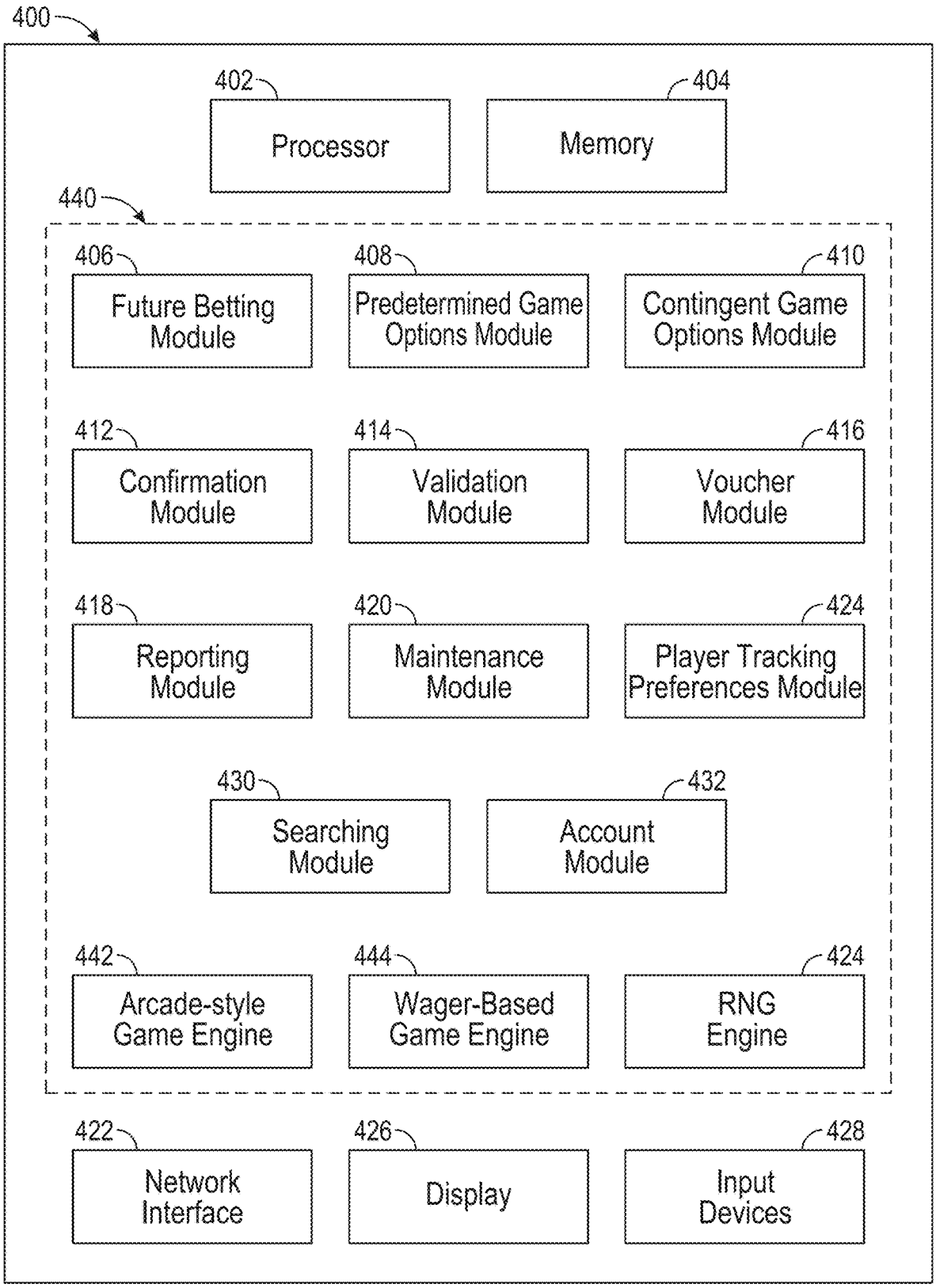
FIG. 4 is a block diagram of electronic gaming device, according to an embodiment.

FIG. 4 shows a block diagram 400 of electronic gaming device 400 according to one embodiment. As shown, electronic gaming device 400 may include a processor 402, a memory 404, a network interface 422, input devices 428, and a display 426. Processor 402 may generate gaming options based on predetermined betting structures and/or outcome categories. Predetermined betting structures may utilize more than one outcome category to generate via processor 402 gaming options. Predetermined betting structures may combine any outcome category with any other outcome category to gaming options. The processor 402 may offer a gaming option that is structured so that the gaming option relates to more than one EGD. Processor 402 may generate contingent gaming options and/or predetermined gaming options. Contingent gaming options 410 may be structures configured such that a wager is activated when a triggering event occurs.

Network interface 422 may be configured to enable the electronic gaming device 400 to communicate with remote devices/systems such as, for example, video/multimedia server(s), accounting/transaction server(s), gaming server(s), authentication server(s), player tracking server(s), voucher server(s) over a communication network, such as shown at 110, 205 and 310. Input devices 428 may be or include mechanical buttons, electronic buttons, one or more touchscreens, microphones, cameras, optical scanners, or any combination thereof. Input devices 428 may be utilized to make a wager, to make an offer to buy or sell a voucher, to determine a voucher's worth, to cash in a voucher, to modify (e.g., change sound level, configuration, font, language, etc.) electronic gaming device 400, to select a movie or music, to select type of content to be displayed on main and/or auxiliary screen(s) of EGD, or any combination thereof.

Arcade-style game engine 442 may be configured to manage the arcade-style game play portion (or entertainment portion) of the hybrid arcade/wager-based game. In contrast, a wager-based game engine 444 may be configured to manage the wager-based game event portion(s) of games according to embodiments. A Random Number Generator (RNG) Engine 446 may be provided and may include software and/or hardware algorithm and/or processes which are used to generate random outcomes and may be used by the wager-based game engine to generate wager-based game event outcomes.

Display 426 may show video streams from one or more gaming devices, gaming objects from one or more gaming devices, computer generated graphics, predetermined gaming options, and/or contingent gaming options. The memory 404 may include various memory modules 440, including a future betting module 406, a predetermined game options module 408, a contingent game options module 410, a confirmation module 412, a validation module 414, a voucher module 416, a reporting module 418, a maintenance module 420, a player tracking preferences module 424, a searching module 430, and an account module 432.

Future betting module 406 may store data relating to the predetermined betting structure. Processor 402 may utilize data in future betting module 406 to generate predetermined gaming options and/or contingent gaming options. Any other processor (e.g., gaming server 225, any virtualized gaming server, etc.) may implement the functions of processor 402. Predetermined game options module 408 may store data relating to predetermined gaming options, which may be offered to a player. The contingent game options module 410 may store data relating to contingent gaming options, which may be offered to a player. The confirmation module 412 may utilize data received from a voucher, the transaction history of the voucher (e.g., in the case in which the voucher changed hands in a secondary market), and/or the identity of the player to confirm the value of the voucher. In another example, confirmation module 412 may utilize game event data, along with voucher data to confirm the value of the voucher. A validation module 414 may utilize data received from a voucher to confirm the validity of the voucher. Voucher module 416 may store data relating to generated vouchers, redeemed vouchers, bought vouchers, and/or sold vouchers. Reporting module 418 may generate reports related to a performance of electronic gaming device 400, electronic gaming system(s), hybrid arcade/wager-based game(s), video streams, gaming objects, credit device(s) or identification device(s), for example.

In one implementation, reporting module 418 may reside on a central server and may be configured to aggregate and generate real time statistics on betting activities at one or more hybrid arcade/wager-based games at one or more participating casinos. The aggregate betting statistics may include trends (e.g., aggregate daily wager volume and wager amount by game types, by casinos, and the like), top games with the most payouts, top tables with the most payouts, top search structures used by players, most popular hybrid arcade/wager-based game(s) by wager volume, most searched for game, hybrid arcade/wager-based game(s) with least payouts, weekly trends, monthly trends, and other statistics related to game plays, wagers, people, location, and searches.

Maintenance module 420 may track any maintenance that is implemented on electronic gaming device 400 and/or electronic gaming system 200. Maintenance module 420 may schedule preventative maintenance and/or request a service call based on a device error. The player tracking preferences module 424 may compile and track data associated with a player's preferences.

Searching module 430 may include one or more searching structures, one or more searching algorithms, and/or any other searching mechanisms. In one example, the search may end once one or more triggering events are determined. In another example, the search may end once data has been received from a predetermined number (e.g., one, two, ten, one hundred, all) of the devices. In another example, the search may be based on a predetermined number of devices to be searched in combination with a predetermined number of search results to be obtained. In another example, the searching structures may be based on one or more specific games. In another example, the searching structure may be based on a player's preferences, past transactional history, player input, a hybrid arcade/wager-based game or game type, a particular EGD, a particular casino, a particular location within a casino, game outcomes over a time period, payout over a time period, and/or any other criteria. Searching algorithms may be dynamic searching programs, which may be modified based on one or more past results, as described previously. In another example, the search algorithm may generate a search priority based on the probability of success various events and/or conditions. In some embodiments, the search algorithm may utilize any dynamic feedback procedure to enhance current and/or future searching results.

Account module 432 may include data relating to an account balance, a wager limit, a number of wagers placed, credit limits, any other player information, and/or any other account information. Data from account module 432 may be utilized to determine whether a wager may be accepted. For example, when a search has determined a triggering event, the device and/or system may determine whether to allow this wager based on one or more of a wager amount, a number of wagers, a wager limit, an account balance, and/or any other criteria.

In at least one embodiment, at least a portion of the modules discussed in block diagram 400 may reside locally in gaming terminal 400. However, in at least some embodiments, at least part of the functions performed by these modules may be implemented in one or more remote servers. For instance, modules 406-420 and 424 may each be on a remote server, communicating with gaming terminal 400 via a network interface such as Ethernet in a local area network (LAN) or a wide area network (WAN) topology. In some implementations, these servers may be physical servers in a data center. In some other implementations, these servers may be virtualized. In yet some other implementations, the functions performed by these modules may be implemented as web services. For example, the predetermined game options module 408 may be implemented in software as a web service provider. Gaming terminal 400 would make service requests over the web for the available predetermined wager options to be displayed. Regardless of how the modules and their respective functions are implemented, the interoperability with the gaming terminal 400 is seamless. In one implementation, reporting module 418 may reside on a central server and may be configured to aggregate and generate real time statistics on betting activities at one or more hybrid arcade/wager-based games at one or more participating casinos. The aggregate betting statistics may include trends (e.g., aggregate daily wager volume and wager amount by game types, by casinos, and the like), top games with the most payouts, top EGDs with the most payouts, top search structures used by players, most popular hybrid arcade/wager-based game(s) by wager volume, most searched for game(s), EGDs with least payouts, weekly trends, monthly trends, and other statistics related to game plays, wagers, people, location, and searches.

Figure 5:
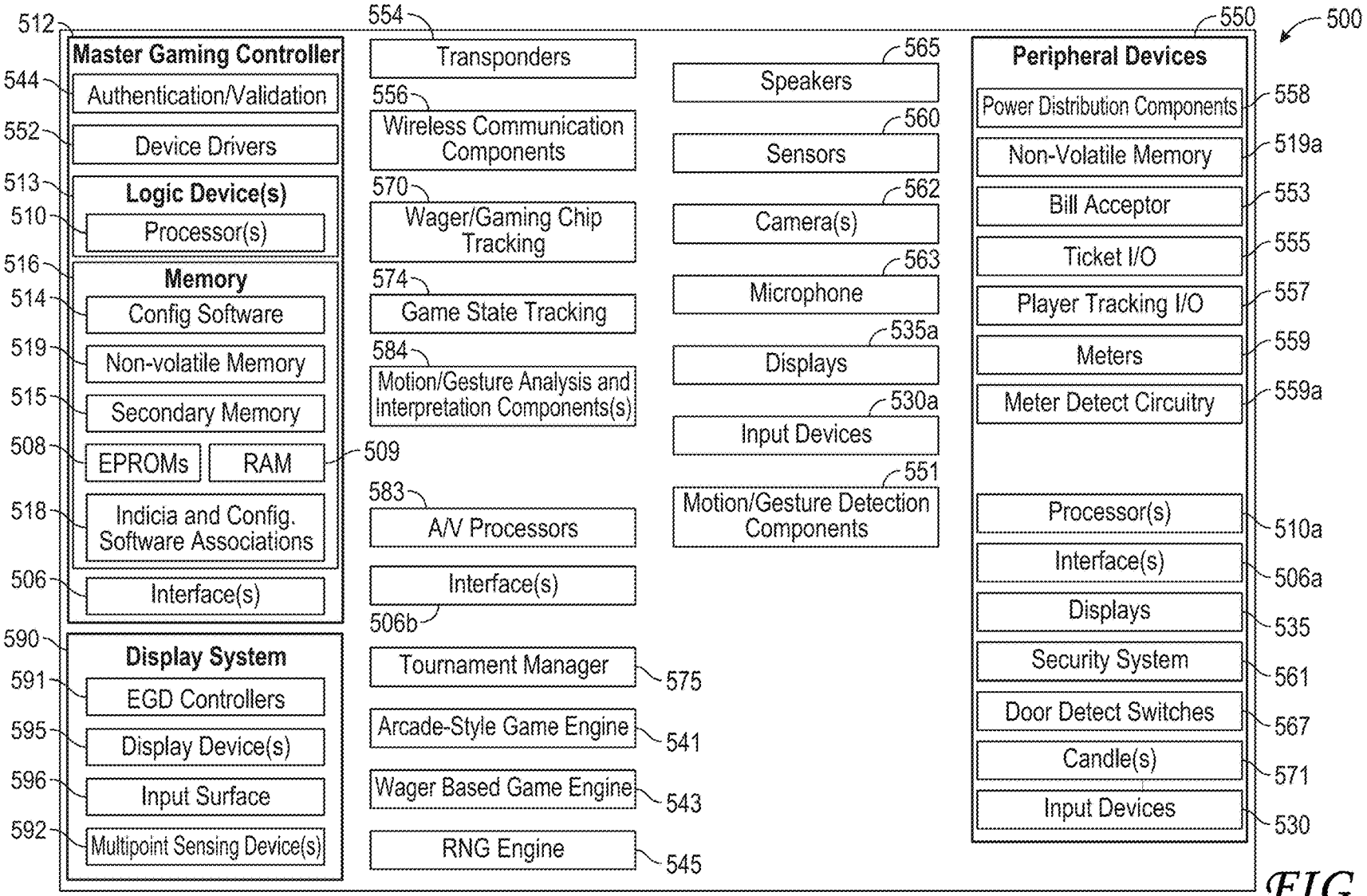
FIG. 5 is a block diagram of an intelligent electronic gaming system, according to one embodiment.

FIG. 5 is a block diagram of an exemplary intelligent multi-player electronic gaming system 500 according to one embodiment. Gaming system 500 may be implemented as a gaming server or as an electronic gaming machine (e.g., EGM) or electronic gaming device (e.g., EGD).

As shown, gaming system 500 may include at least one processor 510, at least one interface 506, and memory 516. Additionally, gaming system 500 may include at least one master gaming controller 512, a multi-touch sensor and display system 590, a plurality of peripheral device components 550, and various other components, devices, systems such as, for example, arcade-style game engine(s) 541; wager-based game engine(s) 543; RNG engine(s) 545; transponders 554; wireless communication components 556; gaming chip/wager token tracking components 570; games state tracking components 574; motion/gesture analysis and interpretation components 584, and audio/video processors 583 which, for example, may include functionality for detecting, analyzing and/or managing various types of audio and/or video information relating to various activities at the gaming system. Various interfaces 506*b* may be provided for communicating with other devices, components and systems, as may be tournament manager 575; sensors 560; one or more cameras 562; one or more microphones 563; secondary display(s) 535*a*; input devices 530*a*; motion/gesture detection components 551; and peripheral devices 550.

The arcade-style game engine(s) 541 may be configured to manage the arcade-style game play portion (or entertainment portion) of the hybrid arcade/wager-based game. Conversely, the wager-based game engine(s) 543 may be configured to manage the wager-based game event portion(s) of the hybrid arcade/wager-based game. RNG engine(s) 545 may include software and/or hardware algorithm and/or processes used to generate random outcomes, and may be used by the wager-based game engine to generate wager-based game event outcomes. Monetary payout manager 522 may be configured or designed to include functionality for determining the appropriate monetary payout(s) (if any) to be distributed to player(s) based on the outcomes of the wager-based game events which are initiated during play of one or more hybrid arcade/wager-based games. The non-monetary payout manager 524 may be configured to include functionality for determining the appropriate non-monetary payout(s) (if any) to be awarded or distributed to player(s) based on the outcomes of the wager-based game events which are initiated during play of one or more hybrid arcade/wager-based games.

One or more cameras (e.g., 562) may be used to monitor, stream and/or record image content and/or video content relating to persons or objects within each camera's view. For example, in at least one embodiment where the gaming system is implemented as an EGD, camera 562 may be used to generate a live, real-time video feed of a player (e.g., or other person) who is currently interacting with the EGD. In some embodiments, camera 562 may be used to verify a user's identity (e.g., by authenticating detected facial features), and/or may be used to monitor or tract facial expressions and/or eye movements of a user or player who is interacting with the gaming system.

In at least one embodiment, display system 590 may include EGD controllers 591; multipoint sensing device(s) 592 (e.g., multi-touch surface sensors/components); display device(s) 595; and Input/touch surface 596. According to embodiments, display surface(s) 595 may include one or more display screens. Master gaming controller 512 may include authentication/validation components 544; device drivers 552; logic devices 513, which may include one or more processors 510; memory 516, which may include configuration software 514, non-volatile memory 519, EPROMS 508, RAM 509, associations 518 between indicia and configuration software, and interfaces 506.

In at least one embodiment, the peripheral devices 550 may include power distribution components 558; non-volatile memory 519*a* (e.g., and/or other types of memory); bill acceptor 553; ticket I/O 555; player tracking I/O 557; meters 559 (e.g., hard and/or soft meters); meter detect circuitry 559*a*; processor(s) 510*a*; interface(s) 506*a*; display(s) 535; independent security system 561; door detect switches 567; candles, etc. 571; input devices 530, for example.

In one implementation, processor 510 and master gaming controller 512 may be included in a logic device 513 enclosed in a logic device housing. The processor 510 may include any conventional processor or logic device configured to execute software (i.e., sequences of computer-readable instructions to be executed) allowing various tasks such as communicating with a remote source via communication interface 506, such as a server that stores authentication information or games; converting signals read by an interface to a format corresponding to that used by software or memory in the gaming system; accessing memory to configure or reconfigure game parameters in the memory according to indicia read from the device; communicating with interfaces, various peripheral devices and/or I/O devices; operating peripheral devices such as, for example, card readers, paper ticket readers, etc.; operating various I/O devices such as, for example, displays 535 and input devices 530. For instance, the processor 510 may send messages including game play information to the displays 535 to inform players of game play/event information, wagering information, and/or other desired information.

In at least one implementation, the gaming system may include card readers such as used with credit cards, or other identification code reading devices to allow or require player identification in connection with play of the card game and associated recording of game action. Such a player identification interface can be implemented in the form of a variety of magnetic and/or chip-card card readers commercially available for reading a player-specific identification information. The player-specific information can be provided on specially constructed magnetic cards issued by a casino, or magnetically coded credit cards or debit cards frequently used with national credit organizations such as Visa, MasterCard, American Express, or banks and other institutions.

The gaming system may include other types of participant identification mechanisms which may use a fingerprint image, eye blood vessel image reader, or other suitable biometric information to confirm identity of the player. Such personalized identification information could also be used to confirm credit use of a smart card, transponder, and/or player's personal player input device (e.g., UID).

The gaming system 500 also includes memory 516 which may include, for example, volatile memory (e.g., RAM 509), non-volatile memory 519 (e.g., disk memory, FLASH memory, EPROMs, etc.), unalterable memory (e.g., EPROMs 508), etc. The memory may be configured or designed to store, for example: 1) configuration software 514 such as all the parameters and settings for a game playable on the gaming system; 2) associations 518 between configuration indicia read from a device with one or more parameters and settings; 3) communication protocols allowing the processor 510 to communicate with peripheral devices and I/O devices 4) a secondary memory storage device 515 such as a non-volatile memory device, configured to store gaming software related information (e.g., the gaming software related information and memory may be used to store various audio files and games not currently being used and invoked in a configuration or reconfiguration); 5) communication transport protocols (e.g., such as, for example, TCP/IP, USB, Firewire, IEEE1394, Bluetooth, IEEE 802.11x (e.g., IEEE 802.11 standards), hiperlan/2, HomeRF, etc.) for allowing the gaming system to communicate with local and non-local devices using such protocols; etc. In one implementation, the master gaming controller 512 communicates using a serial communication protocol. A few examples of serial communication protocols that may be used to communicate with the master gaming controller include but are not limited to USB, RS-232 and Netplex (e.g., a proprietary protocol developed by IGT, Reno, Nev.).

A plurality of device drivers 552 may be stored in memory 516. Example of different types of device drivers may include device drivers for gaming system components, device drivers for gaming system components, etc. The device drivers 552 may utilize a communication protocol of some type that enables communication with a particular physical device. The device driver abstracts the hardware implementation of a device. For example, a device driver may be written for each type of card reader that may be potentially connected to the gaming system. Examples of communication protocols used to implement the device drivers include Netplex, USB, Serial, Ethernet, Firewire, I/O debouncer, direct memory map, serial, PCI, parallel, RF, Bluetooth™, near-field communications (e.g., using near-field magnetics), 802.11 (e.g., Wi-Fi), etc. When one type of a particular device is exchanged for another type of the particular device, a new device driver may be loaded from the memory 516 by the processor 510 to allow communication with the device. For instance, one type of card reader in gaming system 500 may be replaced with a second type of card reader where device drivers for both card readers are stored in the memory 516.

The software units stored in the memory 516 may be upgraded as needed. For instance, when the memory 516 is a hard drive, new games, game options, various new parameters, new settings for existing parameters, new settings for new parameters, device drivers, and new communication protocols may be uploaded to the memory from the master gaming controller 512 or from some other external device. As another example, when the memory 516 includes a CD/DVD drive including a CD/DVD designed or configured to store game options, parameters, and settings, the software stored in the memory may be upgraded by replacing a second CD/DVD with a second CD/DVD. In yet another example, when the memory 516 uses one or more flash memory 519 or EPROM 508 units designed or configured to store games, game options, parameters, settings, the software stored in the flash and/or EPROM memory units may be upgraded by replacing one or more memory units with new memory units which include the upgraded software. One or more of the memory devices, such as the hard-drive, may be employed in a game software download process from a remote software server.

The gaming system 500 may also include various authentication and/or validation components 544 which may be used for authenticating/validating specified gaming system components such as, for example, hardware components, software components, firmware components, information stored in the gaming system memory 516, etc.

Sensors 560 may include, for example, optical sensors, pressure sensors, RF sensors, Infrared sensors, motion sensors, audio sensors, image sensors, thermal sensors, biometric sensors, etc. As mentioned previously, such sensors may be used for a variety of functions such as, for example: detecting the presence and/or monetary amount of gaming chips which have been placed within a player's wagering zone and/or detecting (e.g., in real time) the presence and/or monetary amount of gaming chips which are within the player's personal space, for example. In one implementation, at least a portion of the sensors 560 and/or input devices 530 may be implemented in the form of touch keys selected from a wide variety of commercially available touch keys used to provide electrical control signals. Alternatively, some of the touch keys may be implemented by a touch-screen display. For example, in at least one implementation, the gaming system player may include input functionality for enabling players to provide their game play decisions/instructions (e.g., and/or other input) to the EGD using the touch keys and/or other player control sensors/buttons. Additionally, such input functionality may also be used for allowing players to provide input to other devices in the casino gaming network (e.g., such as, for example, player tracking systems, side wagering systems, etc.)

Wireless communication components 556 may include one or more communication interfaces having different architectures and utilizing a variety of protocols such as, for example, 802.11 (e.g., Wi-Fi), 802.15 (e.g., including Bluetooth™), 802.16 (e.g., WiMAX), 802.22, Cellular standards such as CDMA, CDMA2000, WCDMA, Radio Frequency (e.g., RFID), Infrared, Near Field Magnetic communication protocols, etc. The communication links may transmit electrical, electromagnetic or optical signals which carry digital data streams or analog signals representing various types of information. An example of a near-field communication protocol is the ECMA-340 "Near Field Communication-Interface and Protocol (e.g., NFCIP-1)", published by ECMA International (e.g., www.ecma-international.org), herein incorporated by reference in its entirety for all purposes. It will be appreciated that other types of Near Field Communication protocols may be used including, for example, near field magnetic communication protocols, near field RF communication protocols, and/or other wireless protocols which provide the ability to control with relative precision (e.g., on the order of centimeters, inches, feet, meters, etc.) the allowable radius of communication between at least 5 devices using such wireless communication protocols.

Power distribution components 558 may include, for example, components or devices which are operable for providing wireless power to other devices. For example, in one implementation, the power distribution components 558 may include a magnetic induction system which is adapted to provide wireless power to one or more portable UIDs at the gaming system. In one implementation, a UID docking region may include a power distribution component which is able to recharge a UID placed within the UID docking region without requiring metal-to-metal contact.

A motion/gesture detection component(s) 551 may be configured or designed to detect player movements and/or gestures and/or other input data from the player. In some implementations, each gaming system may have its own respective motion/gesture detection component(s). In other embodiments, motion/gesture detection component(s) 551 may be implemented as a separate sub-system of the gaming system which is not associated with any one specific gaming system or device.

Figure 6:
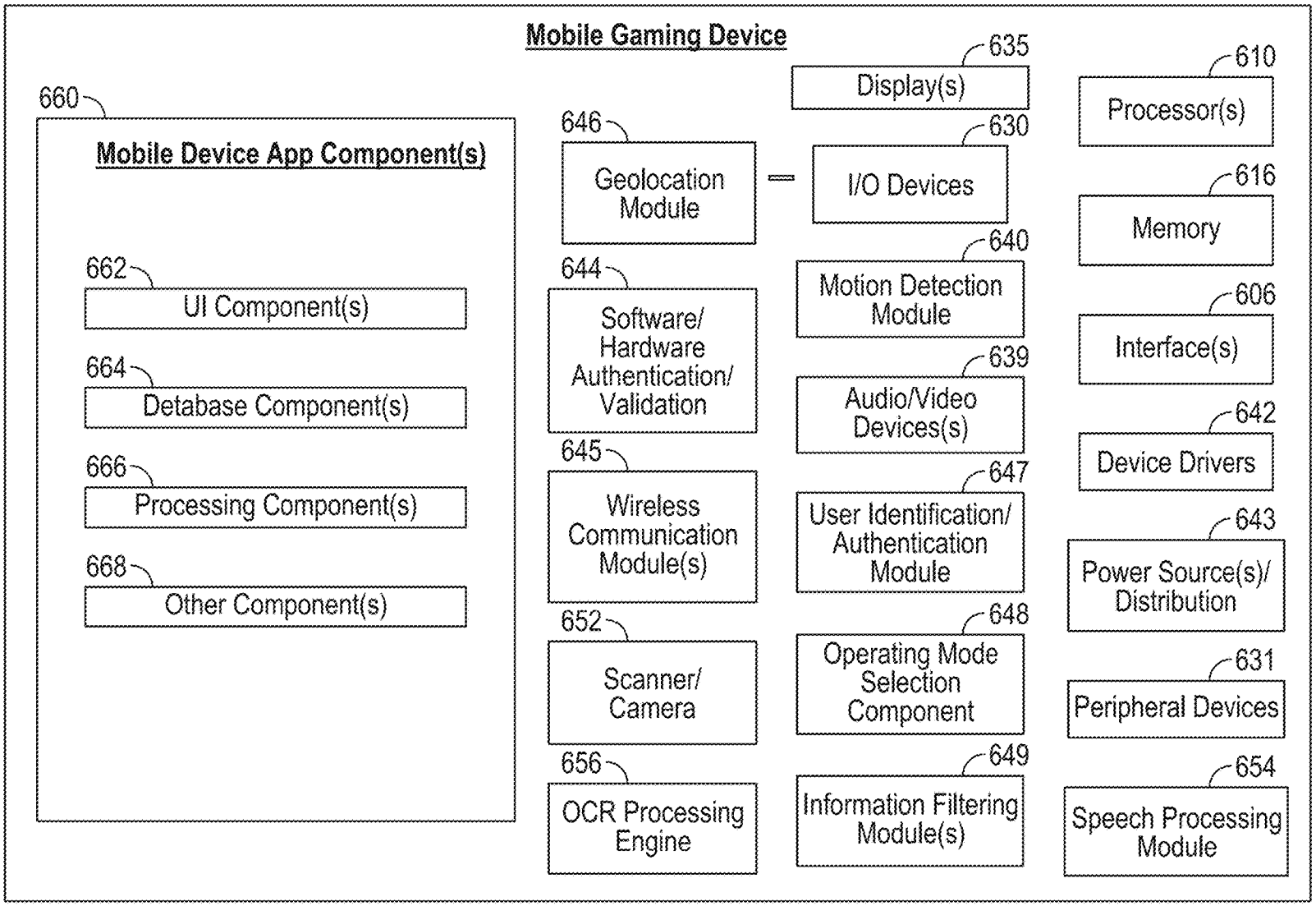
FIG. 6 is a block diagram of a mobile gaming device with which an embodiment may be practiced.

FIG. 6 is a block diagram of an exemplary mobile gaming device 600 in accordance with a specific embodiment. In at least one embodiment, one or more players may participate in a game session using mobile gaming devices. In at least some embodiments, the mobile gaming device may be configured or designed to include or provide functionality which is similar to that of an electronic gaming device (e.g., EGD) such as that described, for example, in FIG. 4.

As shown in FIG. 6, mobile gaming device 600 may include mobile device application components (e.g., 660), which, for example, may include UI components 662; database components 664; processing components 666 and/or other components 668 which, for example, may include components for facilitating and/or enabling the mobile gaming device to carry out the functionality described herein.

The mobile gaming device 600 may include mobile device app component(s) that have been configured or designed to provide functionality for enabling or implementing at least a portion of the functionality of the hybrid arcade/wager-based game techniques at the mobile gaming device.

According to embodiments, various aspects, features, and/or functionalities of the mobile gaming device may be performed, implemented and/or initiated by processor(s) 610; device drivers 642; memory 616; interface(s) 606; power source(s)/distribution 643; geolocation module 646; display(s) 635; I/O devices 630; audio/video devices(s) 639; peripheral devices 631; motion detection module 640; user identification/authentication module 647; client app component(s) 660; other component(s) 668; UI Component(s) 662; database component(s) 664; processing component(s) 666; software/hardware authentication/validation 644; wireless communication module(s) 645; information filtering module(s) 649; operating mode selection component 648; speech processing module 654; scanner/camera 652 and/or OCR processing engine 656, for example.

Figure 7:
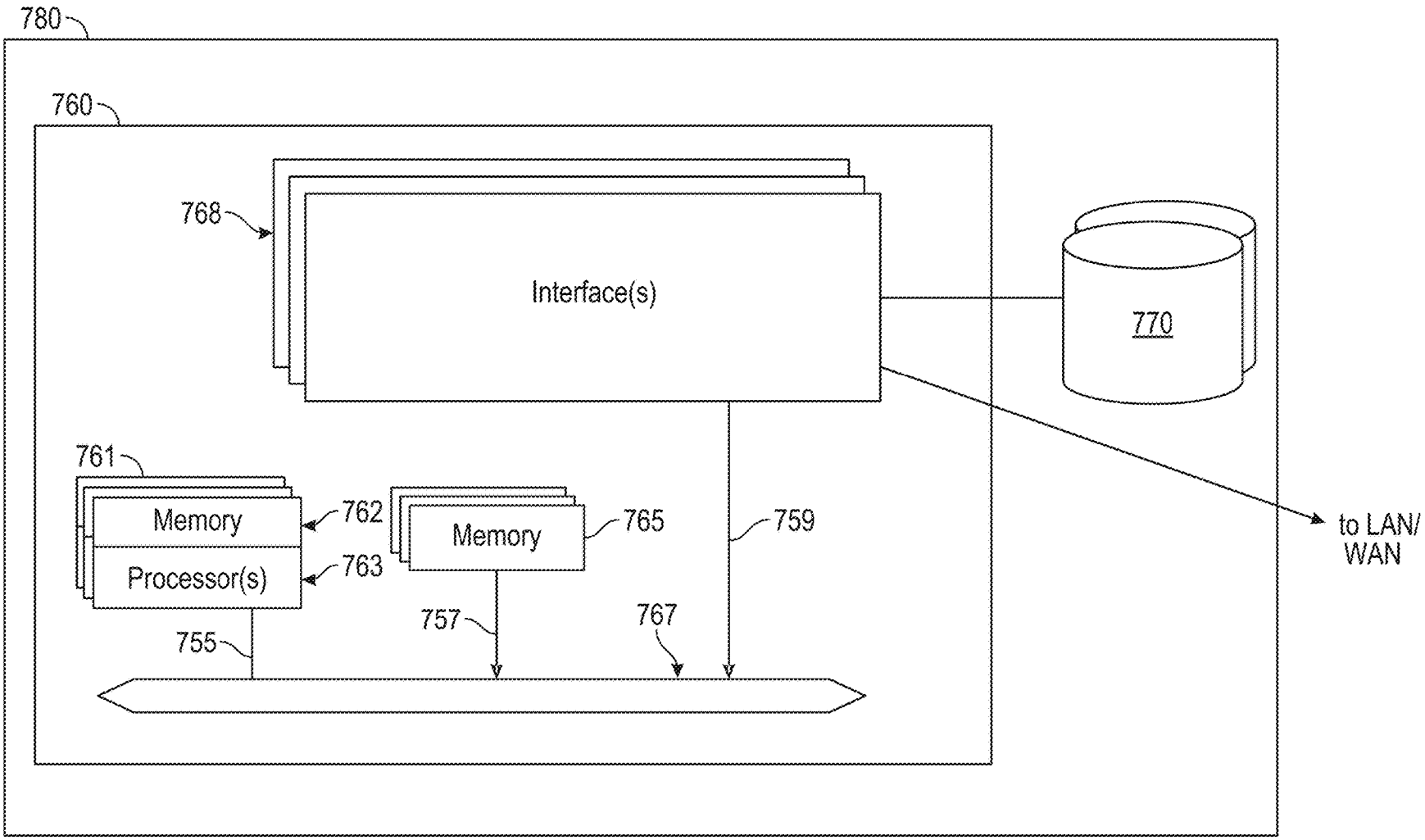
FIG. 7 shows a system server suitable for implementing various aspects of embodiments described herein.

FIG. 7 shows a system server 780 that may be configured according to embodiments. The system server 780 may include at least one network device 760, and at least one storage device 770 (e.g., such as, for example, a direct attached storage device). In one embodiment, system server 780 may be configured to implement at least some of the hybrid arcade/wager-based game techniques described herein. Network device 760 may include a master central processing unit (e.g., CPU) 762, interfaces 768, and a bus 767 (e.g., a PCI bus). When acting under the control of appropriate software or firmware, the CPU 762 may be responsible for implementing specific functions associated with the functions of a desired network device. For example, when configured as a server, the CPU 762 may be responsible for analyzing packets; encapsulating packets; forwarding packets to appropriate network devices; instantiating various types of virtual machines, virtual interfaces, virtual storage volumes, virtual appliances; etc. The CPU 762 preferably accomplishes at least a portion of these functions under the control of software including an operating system (e.g., Linux), and any appropriate system software (e.g., such as, for example, AppLogic (e.g., TM) software).

CPU 762 may include one or more processors 763 such as, for example, one or more processors from the AMD, Motorola, Intel and/or MIPS families of microprocessors. In an alternative embodiment, processor 763 may be specially designed hardware for controlling the operations of system server 780. In a specific embodiment, a memory 761 (e.g., such as non-volatile RAM and/or ROM) also forms part of CPU 762. However, there are different ways in which memory could be coupled to the system. Memory block 761 may be used for a variety of purposes such as, for example, caching and/or storing data, programming instructions, etc.

Interfaces 768 may be typically provided as interface cards. Alternatively, one or more of the interfaces 768 may be provided as on-board interface controllers built into the system motherboard. Generally, they control the sending and receiving of data packets over the network and sometimes support other peripherals used with the system server 780. Among the interfaces that may be provided may be FC interfaces, Ethernet interfaces, frame relay interfaces, cable interfaces, DSL interfaces, token ring interfaces, InfiniBand interfaces, and the like. In addition, various very high-speed interfaces may be provided, such as fast Ethernet interfaces, Gigabit Ethernet interfaces, ATM interfaces, HSSI interfaces, POS interfaces, FDDI interfaces, ASI interfaces, DHEI interfaces and the like. Other interfaces may include one or more wireless interfaces such as, for example, 802.11 (e.g., Wi-Fi) interfaces, 802.15 interfaces (e.g., including Bluetooth™) 802.16 (e.g., WiMAX) interfaces, 802.22 interfaces, Cellular standards such as CDMA interfaces, CDMA2000 interfaces, WCDMA interfaces, TDMA interfaces, Cellular 3G interfaces, and the like.

Generally, one or more interfaces may include ports appropriate for communication with the appropriate media. In some cases, they may also include an independent processor and, in some instances, volatile RAM. The independent processors may control such communications intensive tasks as packet switching, media control and management. By providing separate processors for the communications intensive tasks, these interfaces allow the master microprocessor 762 to efficiently perform routing computations, network diagnostics or security functions.

In at least one embodiment, some interfaces may be configured or designed to allow the system server 780 to communicate with other network devices associated with various local area network (e.g., LANs) and/or wide area networks (e.g., WANs). Other interfaces may be configured or designed to allow network device 760 to communicate with one or more direct attached storage device(s) 770.

Regardless of network device's configuration, it may employ one or more memories or memory modules (e.g., such as, for example, memory block 765, which, for example, may include random access memory (e.g., RAM)) configured to store data, program instructions, logic and processes for the general-purpose network operations and/or other information relating to the functionality of the embodiments described herein. The program instructions may control the operation of an operating system and/or one or more applications, for example. The memory or memories may also be configured to store data structures, and/or other specific non-program information described herein.

Because such information and program instructions may be employed to implement the systems/methods described herein, one or more embodiments relates to machine readable media that include program instructions, state information, etc. for performing various operations described herein. Examples of machine-readable storage media include, but are not limited to, magnetic media such as hard disks, floppy disks, and magnetic tape; optical media such as CD-ROM disks; magneto-optical media such as floptical disks; and hardware devices that may be specially configured to store and perform program instructions, such as read-only memory devices (e.g., ROM) and random-access memory (e.g., RAM). Some embodiments may also be embodied in transmission media such as, for example, a carrier wave travelling over an appropriate medium such as airwaves, optical lines, electric lines, etc. Examples of program instructions include both machine code, such as produced by a compiler, and files containing higher level code that may be executed by the computer using an interpreter.

Figure 8:
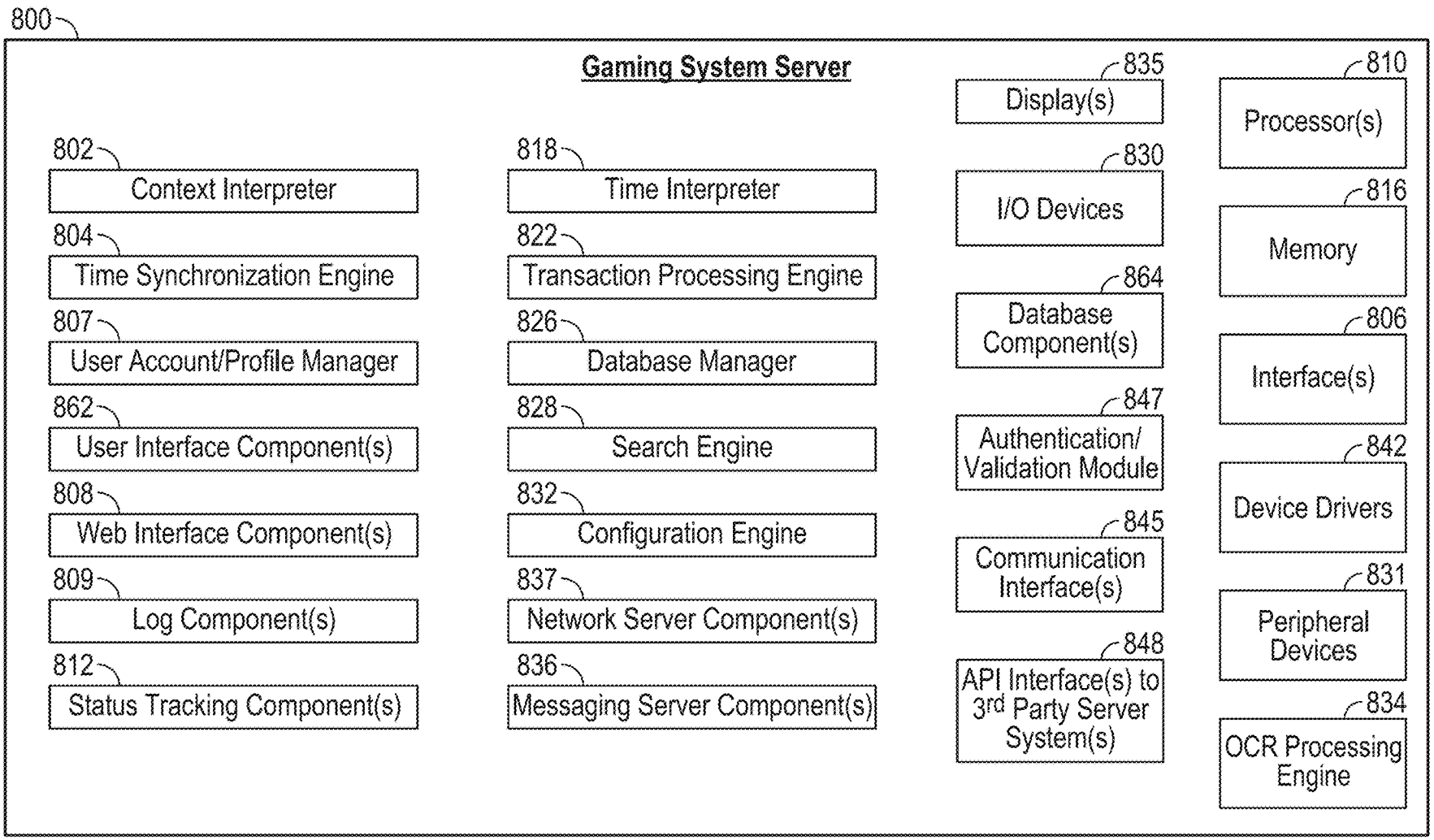
FIG. 8 shows a functional block diagram of a gaming system server according to one embodiment.

FIG. 8 illustrates an example of a functional block diagram of a gaming system server in accordance with a specific embodiment. As shown, the gaming system server 800 may a context interpreter 802 which, for example, may be operable to automatically and/or dynamically analyze contextual criteria relating to a detected set of event(s) and/or condition(s), and automatically determine or identify one or more contextually appropriate response(s) based on the contextual interpretation of the detected event(s)/condition(s). Examples of contextual criteria which may be analyzed may include, but are not limited to, for example, location-based criteria (e.g., geolocation of mobile gaming device, geolocation of EGD, time-based criteria, identity of user(s), user profile information, transaction history information and recent user activities, for example. Time synchronization engine 804 may be operable to manage universal time synchronization (e.g., via NTP and/or GPS). The search engine 828 may be operable to search for transactions, logs, game history information, player information, hybrid arcade/wager-based game information, etc., which may be accessed from one or more local and/or remote databases. The gaming system server 800 may also include a configuration engine 832 that may be configured to determine and handle configuration of various customized configuration parameters for one or more devices, component(s), system(s), and process(es). Time interpreter 818 may be operable to automatically and/or dynamically modify or change identifier activation and expiration time(s) based on various criteria such as, for example, time, location, transaction status, etc. Authentication/validation component(s) 847 (e.g., password, software/hardware info, SSL certificates) may be operable to perform various types of authentication/validation tasks. The transaction processing engine 822 may be operable to handle various types of transaction processing tasks such as, described and/or referenced herein. An OCR processing engine 834 may be operable to perform image processing and optical character recognition of images such as those captured by a gaming device camera, for example. The database manager 826 may be configured to handle various types of tasks relating to database updates, management and access. In at least one embodiment, the database manager may be operable to manage game history databases, player tracking databases and/or other historical record keeping. Log component(s) 809 may be operable to generate and manage transactions history logs, system errors, connections from APIs. Status tracking component(s) 812 may be provided and configured to automatically and/or dynamically determine, assign, and/or report updated transaction status information based, for example, on a state of the transaction. Gateway component(s) may be operable to facilitate and manage communications and transactions with external payment gateways. Web interface component(s) 808 may be operable to facilitate and manage communications and transactions with virtual live electronic gaming device web portal(s). API interface(s) to gaming system server(s) may be operable to facilitate and manage communications and transactions with API Interface(s) to the gaming system server(s). API Interface(s) to 3rd party system server(s) may be provided, which may be operable to facilitate and manage communications and transactions with API interface(s) to 3rd party system server(s).

One or more general-purpose processors 810 may be provided. In an alternative embodiment, at least one processor may be specially designed hardware for controlling the operations of a gaming system. In a specific embodiment, a memory (e.g., such as non-volatile RAM and/or ROM) also forms part of CPU. When acting under the control of appropriate software or firmware, the CPU may be responsible for implementing specific functions associated with the functions of a desired network device. The CPU preferably accomplishes all these functions under the control of software including an operating system, and any appropriate applications software. Memory 816 may be provided. The memory 816 may include volatile memory (e.g., RAM), non-volatile memory (e.g., disk memory, FLASH memory, EPROMs, etc.), unalterable memory, and/or other types of memory. According to different embodiments, one or more memories or memory modules (e.g., memory blocks) may be configured or designed to store data, program instructions for the functional operations of the mobile gaming system and/or other information. The program instructions may control the operation of an operating system and/or one or more applications, for example. The memory or memories may also be configured to store data structures, metadata, identifier information/images, and/or information/data relating to other features/functions described herein. Interface(s) 806 may be provided such as, for example, wired interfaces and/or wireless interfaces. Suitable device driver(s) 842 may also be provided, as may be one or more display(s) 835. Messaging server component(s) 836, may provide various functions and operations relating to messaging activities and communications. Similarly, network server component(s) 837 may be configured to provide various functions and operations relating to network server activities and communications. User account/profile manager component(s) 807 may be provided to manage various aspects of user accounts and/or profiles.

Figure 9:
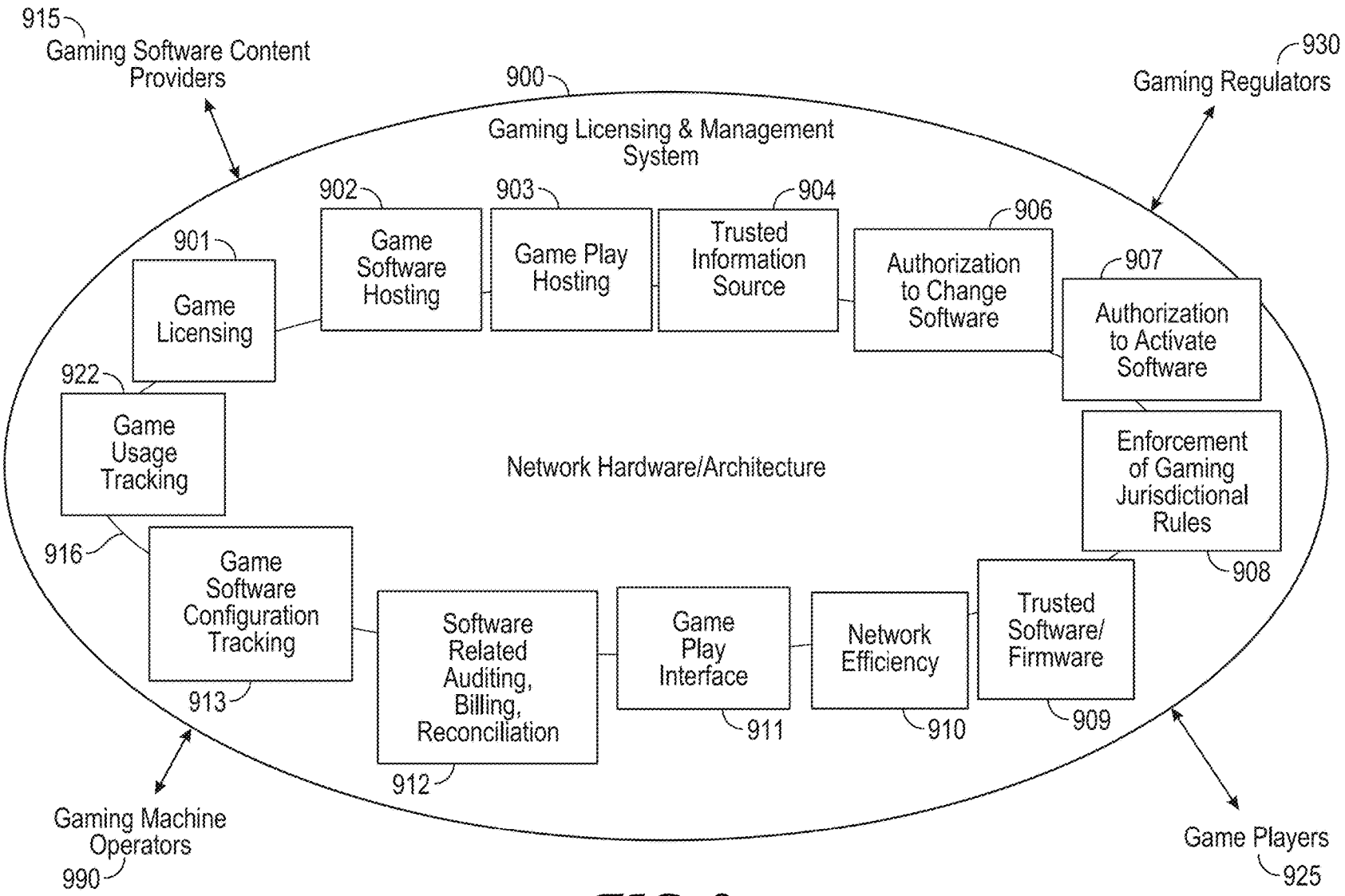
FIG. 9 shows a block diagram illustrating components of a gaming system suitable for implementing an embodiment.

FIG. 9 shows a block diagram illustrating components of a gaming system 900 suitable for implementing various aspects of the embodiments shown and described herein. In FIG. 9, the components of a gaming system 900 for providing game software licensing and downloads are described functionally. The described functions may be instantiated in hardware, firmware and/or software and executed on a suitable device. In the system 900, there may be many instances of the same function, such as multiple game play interfaces 911. Nevertheless, in FIG. 9, only one instance of each function is shown. The functions of the components may be combined. For example, a single device may comprise the game play interface 911 and include trusted memory devices or sources 909.

The gaming system 900 may receive inputs from different groups/entities and output various services and or information to these groups/entities. For example, game players 925 primarily input cash or indicia of credit into the system, make game selections that trigger software downloads, and receive entertainment in exchange for their inputs. Game software content providers provide game software for the system and may receive compensation for the content they provide based on licensing agreements with the gaming machine operators. Gaming machine operators select game software for distribution, distribute the game software on the gaming devices in the system 900, receive revenue for the use of their software and compensate the gaming machine operators. The gaming regulators 930 provide rules and regulations that are applicable to the gaming system and receive reports and other information confirming adherence to these rules.

The game software license host 901 may be a server connected to a number of remote gaming devices that provides licensing services to the remote gaming devices. For example, the license host 901 may 1) receive token requests for tokens used to activate software executed on the remote gaming devices, 2) send tokens to the remote gaming devices, 3) track token usage and 4) grant and/or renew software licenses for software executed on the remote gaming devices. The token usage may be used in use-based licensing schemes, such as a pay-per-use scheme.

In another embodiment, a game usage-tracking host 922 may track the usage of game software on a plurality of devices in communication with the host. The game usage-tracking host 922 may be in communication with a plurality of game play hosts and gaming machines. From the game play hosts and gaming machines, the game usage tracking host 922 may receive updates of an amount that each game available for play on the devices may be played and on amount that may be wagered per game. This information may be stored in a database and used for billing according to methods described in a utility based licensing agreement.

The game software host 902 may provide game software downloads, such as downloads of game software or game firmware, to various devices in the game system 900. For example, when the software to generate the game is not available on the game play interface 911, the game software host 902 may download software to generate a selected game of chance played on the game play interface. Further, the game software host 902 may download new game content to a plurality of gaming machines responsive to a request from a gaming machine operator.

The game software host 902 may also include a game software configuration-tracking host 913. The function of the game software configuration-tracking host is to keep records of software configurations and/or hardware configurations for a plurality of devices in communication with the host (e.g., denominations, number of paylines, paytables, max/min wagers).

A game play host device 903 may include a host server connected to a plurality of remote clients that generates games of chance that are displayed on a plurality of remote game play interfaces 911. For example, the game play host device 903 may include a server that provides central determination of wager outcomes on a plurality of connected game play interfaces 911. As another example, the game play host device 903 may generate games of chance, such as slot games or wager-based video games, for display on a remote client. A game player using the remote client may be able to select from a number of games that are provided on the client by the host device 903. The game play host device 903 may receive game software management services, such as receiving downloads of new game software, from the game software host 902 and may receive game software licensing services, such as the granting or renewing of software licenses for software executed on the device 903, from the game license host 901.

The game play interfaces or other gaming devices in the gaming system 900 may be portable devices, such as electronic tokens, cell phones, smart cards, tablet PCs and PDAs. The portable devices may support wireless communications. The network hardware architecture 916 may be enabled to support communications between wireless mobile devices and other gaming devices in gaming system. The wireless mobile devices may be used to play games of chance, such as described herein.

The gaming system 900 may use a number of trusted information sources. Trusted information sources 904 may include devices, such as servers, that provide information used to authenticate/activate other pieces of information. Cyclic Redundancy Check (CRC) values used to authenticate software, license tokens used to allow the use of software or product activation codes used to activate software are examples of trusted information that might be provided from a trusted information source 904. Trusted information sources may include a memory device, such as an EPROM, that includes trusted information used to authenticate other information. For example, a game play interface 911 may store a private encryption key in a trusted memory device that is used in a private key-public key encryption scheme to authenticate information from another gaming device.

Gaming devices storing trusted information might utilize apparatus or methods to detect and prevent tampering. For instance, trusted information stored in a trusted memory device may be encrypted to prevent its misuse. In addition, the trusted memory device may be secured behind a locked door. Further, one or more sensors may be coupled to the memory device to detect tampering with the memory device and provide some record of the tampering. In yet another example, the memory device storing trusted information might be designed to detect tampering attempts and clear or erase itself when an attempt at tampering may be detected.

The gaming system 900 of example embodiments may include devices 906 that provide authorization to download software from a second device to a second device and devices 907 that provide activation codes or information that allow downloaded software to be activated. The devices, 906 and 907, may be remote servers and may also be trusted information sources.

A device 906 that monitors a plurality of gaming devices to determine adherence of the devices to gaming jurisdictional rules 908 may be included in the system 900. A gaming jurisdictional rule server may scan software and the configurations of the software on a number of gaming devices in communication with the gaming rule server to determine whether the software on the gaming devices is valid for use in the gaming jurisdiction where the gaming device is located. For example, the gaming rule server may request a digital signature, such as CRCs, of particular software components and compare them with an approved digital signature value stored on the gaming jurisdictional rule server.

Further, the gaming jurisdictional rule server may scan the remote gaming device to determine whether the software is configured in a manner that is acceptable to the gaming jurisdiction where the gaming device is located. For example, a maximum wager limit may vary from jurisdiction to jurisdiction and the rule enforcement server may scan a gaming device to determine its current software configuration and its location and then compare the configuration on the gaming device with approved parameters for its location.

A gaming jurisdiction may include rules that describe how game software may be downloaded and licensed. The gaming jurisdictional rule server may scan download transaction records and licensing records on a gaming device to determine whether the download and licensing was carried out in a manner that is acceptable to the gaming jurisdiction in which the gaming device is located. In general, the game jurisdictional rule server may be utilized to confirm compliance to any gaming rules passed by a gaming jurisdiction when the information needed to determine rule compliance is remotely accessible to the server.

Game software, firmware or hardware residing a particular gaming device may also be used to check for compliance with local gaming jurisdictional rules. When a gaming device is installed in a particular gaming jurisdiction, a software program including jurisdiction rule information may be downloaded to a secure memory location on a gaming machine or the jurisdiction rule information may be downloaded as data and utilized by a program on the gaming machine. The software program and/or jurisdiction rule information may check the gaming device software and software configurations for compliance with local gaming jurisdictional rules. In another embodiment, the software program for ensuring compliance and jurisdictional information may be installed in the gaming machine prior to its shipping, such as at the factory where the gaming machine is manufactured.

The gaming devices in game system 900 may utilize trusted software and/or trusted firmware. Trusted firmware/software is trusted in the sense that is used with the assumption that it has not been tampered with. For instance, trusted software/firmware may be used to authenticate other game software or processes executing on a gaming device. As an example, trusted encryption programs and authentication programs may be stored on an EPROM on the gaming machine or encoded into a specialized encryption chip. As another example, trusted game software, e.g., game software approved for use on gaming devices by a local gaming jurisdiction may be required on gaming devices on the gaming machine.

The devices may be connected by a network 916 with different types of hardware using different hardware architectures. Game software can be quite large and frequent downloads can place a significant burden on a network, which may slow information transfer speeds on the network. For game-on-demand services that require frequent downloads of game software in a network, efficient downloading is essential for the service to viable. Thus, network efficient devices 910 may be used to actively monitor and maintain network efficiency. For instance, software locators may be used to locate nearby locations of game software for peer-to-peer transfers of game software. In another example, network traffic may be monitored and downloads may be actively rerouted to maintain network efficiency.

One or more devices may provide game software and game licensing related auditing, billing and reconciliation reports to server 912. For example, a software licensing billing server may generate a bill for a gaming device operator based upon a usage of games over a time period on the gaming devices owned by the operator. In another example, a software auditing server may provide reports on game software downloads to various gaming devices in the gaming system 900 and current configurations of the game software on these gaming devices.

At particular time intervals, the software auditing server 912 may also request software configurations from a number of gaming devices in the gaming system. The server may then reconcile the software configuration on each gaming device. The software auditing server 912 may store a record of software configurations on each gaming device at particular times and a record of software download transactions that have occurred on the device. By applying each of the recorded game software download transactions since a selected time to the software configuration recorded at the selected time, a software configuration is obtained. The software auditing server may compare the software configuration derived from applying these transactions on a gaming device with a current software configuration obtained from the gaming device. After the comparison, the software-auditing server may generate a reconciliation report that confirms that the download transaction records are consistent with the current software configuration on the device. The report may also identify any inconsistencies. In another embodiment, both the gaming device and the software auditing server may store a record of the download transactions that have occurred on the gaming device and the software auditing server may reconcile these records.

In an EGM or EGD, a payout schedule for a wager is a randomized monetary return to the player. Some alternative industry terms for a payout schedule may include paytable, payline, payback percentage or distribution. The phrase "payout schedule" is used and defined here to avoid ambiguity that may be inherent in these alternate terms.

In the simplest terms, a payout schedule can be described as a table of information. Each of the table's Entries (rows) may include at least three elements (columns). One of the elements for an entry may include some identifying information for a wagering event or multiple wagering events. Another element of the entry may include the probability (standard mathematical definition) of the Event occurring. The other important element is the payback value for the wagering event, should the wagering event occur.

The overall Return to the Player (also known as RTP) along with the payback values in the table are generally expressed as either (a) a multiple of the wager or (b) a specific value, such as a dollar (or other currency) amount. All entries in a payout schedule should be expressed in the same terms, as mixing wager multiples and specific values will typically not yield useful information.

In other implementations of a payout schedule, these listed values may not be explicitly present in the table, but may instead be indirectly indicated. For instance, if two six-sided dice were used as a lookup into a payout schedule, the probability of a seven (7) being rolled is higher than any other number. If seven was indicated in the actual payout schedule, it would be indirectly related to the probability of the 7 being rolled (which is 1/6, or 0.1666666 . . . .) Those of skill in the art will recognize that there are many alternate methods of expressing a probability, as well as many alternate methods of specifying a payback value. For instance, rather than specifying the payback value in terms of dollars and cents, or as a multiple of a wager, it could be expressed instead as the value of a "Brand New Car!" or the value of a progressive prize. For clarity, this description will assume that probabilities are real numbers between 0 and 1 inclusive, while payback values will either be multiples of the wager (expressed as percentages) or constant values (such as one dollar ($1)).

Herein, the sum of all probabilities in a payout schedule will equal 1 in a complete payout schedule. It is acceptable to assume that a paytable has a missing entry if the sum of all probabilities is less than 1. This missing entry's probability is equal to one minus the sum of the existing probabilities. The payback value of the missing entry is zero.

If the Sum of the probabilities is greater than one, the payout schedule is invalid.

To use a payout schedule, a random value must be generated. This random value must be used such that each entry in the payout schedule can be identified using some transformation of the random value combined with some form of look-up into the payout schedule using the probability of each entry. For example, consider the following payout schedule in Table 1:

TABLE 1

| Event | Probability | Payback Value |
|---|---|---|
| Die Roll = 1 or 2 or 3 | .5 | $0 |
| Die Roll = 4 | .166666 . . . | $1 |
| Die Roll = 5 | .166666 . . . | $2 |
| Die Roll = 6 | .166666 . . . | $3 |

The value of a payout schedule is a sum of products. Each entry in the payout schedule will have its own entry value. This entry value is simply the product of the probability and the payback value. The value of the payout schedule is the sum of all entry values in the payout schedule. Therefore, for the payout schedule of Table 1, its value is calculated as shown below:

$$(0.5*\$0)+(0.166666*\$1)+(0.166666*\$2)+(0.166666*\$3)=\$1.0$$

In this case, if the wager was $1, and the expected value was $1, the casino (and the player) would expect to neither win nor lose money on this game over time.

Note that random values may have different distributions. Most typical gaming devices use a uniform distribution, as a single random number is used to determine some outcome, such as a reel stop position, a wheel position, the value of a playing card, etc. However, some games or gaming devices may be configured to use a non-uniformly distributed random outcome. One such non-uniform random distribution is the Gaussian distribution. A Gaussian distribution (also known as a Normal distribution) is obtained whenever the sum of multiple uniformly distributed random numbers is calculated. For example, if the sum of two 6-sided dice is used to determine how much to pay the player, the outcome of 7 is more common than any other outcome by virtue of the Gaussian distribution of the random result of summing two 6-sided dice. The outcome is still completely random—it's just not uniformly distributed between 2 and 12. The examples used in this description will assume the generation of random numbers that are uniformly distributed unless otherwise specified. Note, however, that this does not preclude the use of non-uniform distributions in alternate embodiments.

In compliance with virtually all US-based gaming regulations, the randomized return must not be based on any previous actions or outcomes. Therefore, a gaming device is not typically permitted to alter the outcome of a random number generator because the gaming device has paid more or less than some target percentage over time. Therefore, the description and embodiments herein will assume the same constraint.

There are a large number of gambling games that are legal to play in the United States that can be reduced to one or more payout schedules. For example, the simple game of Roulette uses a uniformly-distributed random value (the ball landing somewhere on the wheel) along with a set of rules that denote the payout for each of the various possible outcomes. The payout for "black" is usually one-for-one: If you wager $1 on "black", and the ball lands on a "black" number, you will receive $1 for every $1 bet (aka 2 to 1 odds) For this wager, there are 18 black numbers, 18 red numbers, and (hypothetically) 2 green numbers (0 and 00). The frequency of getting black is 18/38, or roughly 47.4%, and has a value of 2. The frequency of getting "not-black" is roughly 52.6%, and has a value of 0. Therefore, the value to the player (the payout schedule value) for "black" wager on roulette is:

$$(2*47.4\%)+(0*52.6\%)=94.8\%$$

In other words, the casino can expect to win (after many millions of wagers) 1−0.948=0.052, or 5.2 cents, for every dollar wagered on "black" in Roulette. Note: Because no units (currency) was set on the payback values, it can be assumed that they are unit-less and, therefore, suitable to be used as a multiplier for the wager.

A classic slot machine follows a similar schedule. Each possible combination of symbols on the screen (or on a payline) has a specific probability of occurring. That combination also has a payback value (return to player). This payback value may be zero, or it may be millions of dollars. Using the same basic formula that was used in the simple wager of "black" on Roulette, the overall payback percentage of a slot machine is determined by summing up the products of each symbol combination's probability of occurring and the payback value for that combination of symbols.

Over a sufficiently long period of time, the value of a payout schedule converges to a constant, designed value (94.8% in the previous Roulette example). For purposes of calculating the theoretical return to player (RTP) of a game, regardless of the individual details comprising a payout schedule (Roulette vs. Slot Machine vs. other), if the values of two payout schedules (as calculated above) are the same, then the theoretical RTP for the wager will be the same. As such, the use of the term "value of the payout schedule" is inclusive of every possible way that a payout schedule can be constructed.

For instance, if an example stated: "Carrying out a predetermined action (e.g., collecting a Blue Diamond, eating a Power Pill, etc.) results in the evaluation of a payout schedule with a value of 91%, no assumption should be made about how the payout schedule is constructed. In one embodiment, the rolling of a die may be used as the value of the payout schedule. In another embodiment, a slot machine outcome may be used to determine the value of the payout schedule. In yet another embodiment, the spinning of a virtual wheel may be used to determine the value of the payout schedule. For example, a randomized lookup into a lookup-table may be used to establish the value of the payout schedule.

Even if two payout schedules have the same value, the payout schedules may have very different volatilities. In the simplest terms, a payout schedule with a higher volatility will require more wagers to converge to some given confidence interval (standard statistical definition) around the payout schedule value than a payout schedule with a lower volatility. In many (if not most) gambling games, combining the theoretical payback value with the volatility is a significant part of the craftsmanship behind mathematical game design. Unless noted otherwise, the volatility of a payout schedule does not affect the use of the term payout schedule—two payout schedules with the same value may be considered equivalent in various alternate embodiments and examples described herein. Various terms such as counters, tokens, achievements, etc. will all be called Counters in this description.

Herein, the phrase "wagering event" means a wager instance that is generated as a result of a player interacting with a wagering opportunity, or any wagering opportunity within a game that is recognized by the game as a wagering event. wagering opportunities may include hardware-based actions such as: pressing a button, pulling a trigger, touching the screen, etc. wagering opportunities may also include, but are not limited to, virtual events (events that occur virtually within a video game), such as touching or attempting to touch any game object with a player-controlled avatar (humanoid, vehicle, held weapon or fist, etc.) or having the player's avatar come within a certain proximity of the game object, firing a projectile at any game object (either requiring the projectile to hit or simply be fired, or alternately having the projectile aimed such that it eventually comes within a certain proximity to a game object), making a selection or a move or as the result of making a selection or a move (such as placing an "X" on a Tic-Tac-Toe board, moving your piece in a Monopoly game, sliding a tile or gem in a Match-3 game, etc.), and in general taking any action within a game or allowing any interaction to occur within a game, at any point in time or during or after any duration of time. For any of these opportunities, if a wager has been made prior to, simultaneous with or subsequent to their occurrence, and directly or indirectly because of their occurrence, the combination of the wager and the occurrence becomes known as a wagering event. There may be a myriad of possible wagering opportunities within a game. Part of the game's design will be determining which (and when) opportunities may be wagered upon, thereby defining the difference between a wagering opportunity and a wagering event. Some events may not be or include a wagering opportunity until some specific time or upon the occurrence of some other predicate event(s).

According to one embodiment, some wagering events may occur less frequently, may be associated with a greater time delay within the game, may require a greater degree of dexterity or cleverness and/or may generally be more subjectively difficult to accomplish. Some wagering events may be associated with more than one such attribute. Naturally, such wagering events may have a higher perceived value to a player than wagering events that are associated, for example, with a higher frequency of occurring and/or that require a comparatively lesser degree of dexterity, cleverness and/or that are comparatively easier to accomplish.

In any event, regardless of such attributes that may be associated with one or more wagering events, the game must be considered "fair". A primary tenet regarding fairness is that the rules of the game must be completely described to the player, such that the player may make an informed decision whether or not to play the game based on how the game is played. This rule applies to all known regulated gaming jurisdictions. The gaming embodiments shown and described herein are fair and it is assumed that the rules of the game are clearly described to the player.

Also, the game must never pay out so much money that the casino (or other gaming establishment) will consistently lose money to a player that, through luck and/or consistently skillful actions, accomplishes many or all of the wagering events. While it is acceptable, for a player that consistently accomplishes most or all wagering events that are subjectively more valuable, to win more money (including more than he or she put into the gaming machine) than another player that accomplishes none or a limited number of such subjectively more valuable wagering events, the game must be designed in such a manner as to guarantee that the winnings over time, for any player, will not cause the casino to lose money. The embodiments shown and described herein allow for the game designer to guarantee that no player, however, lucky, clever, dexterous or skillful, cannot win more than 100% of his or her wagers over a significantly long period of time and over many iterations of the game. This proposition may be called, in short-hand, the Unacceptably High Payback Rule.

Frequently within a game, there will be wagering events that may be subjectively perceived as being more valuable, harder to accomplish, that occur less frequently (collectively, "harder" wagering events) and there will be wagering events that may be subjectively perceived as being comparatively less valuable, easier to accomplish, that occur more frequently (collectively, "easier" wagering events). For example, in the classic matching game Bejeweled™, matching 3 gems is considered to be easier than matching 4 gems. Also, opportunities to match 3 gems may occur more frequently than do opportunities to match a greater number of gems (4, 5, 6, or 7, for example). In a first-person shooter game, a head shot (smaller target, more difficult to hit) may be considered to be harder and a body shot (larger target, comparatively easier to hit) may be considered to be easier. Because of basic human nature, players typically expect larger rewards for harder activities.

According to one embodiment, one way to address this desire for a larger reward is to assign a different and higher-valued payout schedule to harder wagering events. Such a paradigm allows for a consistently greater return to the skilled player and for an occasionally greater return for the lucky player. Other embodiments are configured to enhance such a paradigm to both enhance all players' experiences and to protect the casino.

According to one embodiment, each individual wager, placed through the gaming machine receiving some player interaction when the player encounters a wagering event, should never have an expected RTP that falls below a specified minimum (such as 75% in Nevada), regardless of game state or game history. According to another embodiment, the overall RTP, over the life of the game, should not exceed some specified maximum, most likely mathematically capped at 100%, even if the player were to successfully and consistently accomplish all available skillful actions required during wagering events. It is to be understood that, over the short term, any player may be rewarded more than his or her wagers. However, even if the luckiest and most skilled player in the world were to play a game machine or configured according to one or more of the embodiments shown and described herein for an extended period of time, that player would never be rewarded a return that cost the casino (or other operator) money.

Notwithstanding, according to one embodiment, the expected RTP of an individual wagering event within a game may be larger for a harder wagering event than the expected RTP for a comparatively easier wagering event within the same game. It is these harder (and/or less-frequently occurring) wagering events that are associated with a better (for the player) RTP, that keep the player engaged in the game at hand, and that heighten his or her excitement during game play. Engaging gameplay is usually an indicator of higher revenue in the gaming industry. Some (easier and/or frequently occurring) wagering events may have an expected RTP of (for example) 75%, while other (harder, and/or less frequently occurring) wagering event may have an expected RTP of, for example, 85% (or even higher than 100%, in certain circumstances) associated therewith.

Consider the exemplary payout schedule table shown in Table 2:

TABLE 2

| Payout | probability | Range | RTP (calculated) |
|---|---|---|---|
| 0 | 80% | 0 . . . 79 | 0 |
| 2 | 10% | 80 . . . 89 | .20 |
| 5 | 5% | 90 . . . 94 | .25 |
| 10 | 5% | 96 . . . 99 | .550 |
| Total RTP (Sum): | | | .95 (95%) |

In this example, a random number is generated and scaled to a value between 0 and 99 (0 . . . 99). Using the "Range" column, the scaled number (0 . . . 99) is used to determine the payout amount to award the player. The "RTP (calculated)" column for each row is simply the product of the Payout and the probability for that row. The sum of the values in this RTP column represents the overall total RTP for the entire payout schedule.

According to some embodiments, lower RTP payout schedules may be enabled for some wagering opportunities and/or less successful players while comparatively higher RTP payout schedules may be enabled for other wagering opportunities and/or comparatively more successful players. In some embodiments, lower RTP payout schedules may be enabled for wagering opportunities that occur often or that the player is statistically more likely to accomplish (i.e., easier wagering opportunities) while higher RTP payout schedules may be enabled for one or more wagering opportunities that occur comparatively less frequently and/or that the player is less likely to successfully accomplish (i.e., harder wagering opportunities). For example, lower RTP payout schedules may be enabled for easier wagering opportunities while higher RTP payout schedules trivial may be enabled for harder wagering opportunities. easier and harder wagering opportunities may be measured, subjectively or objectively, by the amount of game play time required to reach them, cleverness of the player, by the amount of manual dexterity of the player, by the reaction time or speed of the player and/or by any other metric that results in a statistical differential between the rate of unsuccessfully completing a predetermined action or actions upon encountering a predetermined wagering opportunity and the rate of successfully completing the action or actions upon encountering the same predetermined wagering opportunity during game play. Indeed, the player may accept a lower rate of return for accomplishing tasks he or she (and/or the game designer) perceives as easier in exchange for a comparatively higher rate of return for accomplishing tasks he or she (and/or the game designer) perceives as being harder, wagering opportunities that conclude a chapter of the game's narrative or that are thematically significant to the game.

Figure 10:
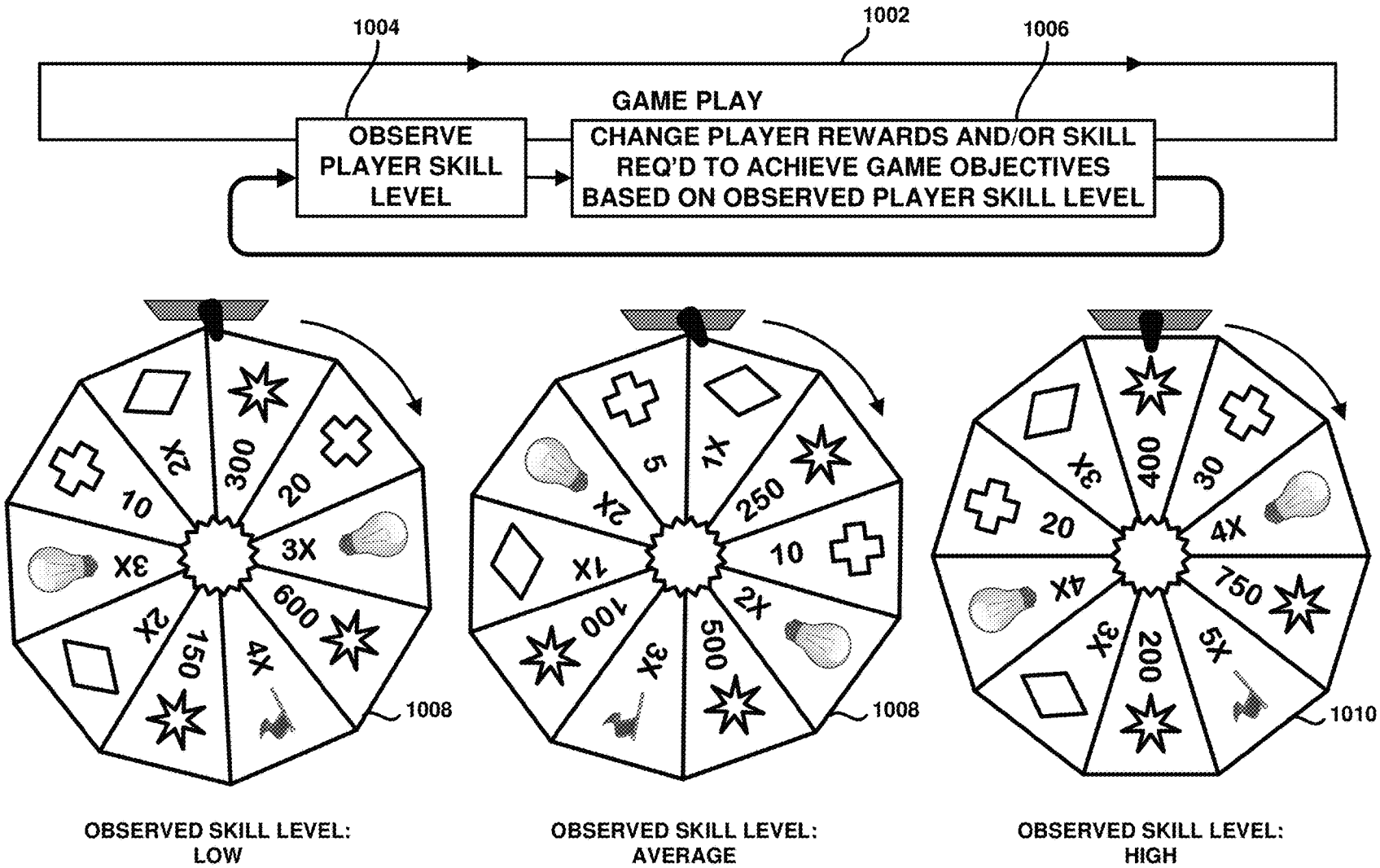
FIG. 10 depicts aspects of a computer-implemented method and skillful wagering game configured to reward players based upon observed skill level, according to one embodiment.

FIG. 10 depicts aspects of a computer-implemented method and skillful wagering game configured to reward players based upon observed skill level, according to one embodiment. As shown therein, reference 1002 represents the course of game play of a skillful wager-based game according to one embodiment. During game play, the skill level of the player may be observed and quantified, as suggested at 1004. The skill level of the player may be determined, for example, by observing the player's interactions with the in-game assets via the regulated gaming machine's user interfaces including joysticks, rollerballs, buttons, levers and the like. More particularly, the player's skill level may be determined by, for example, the speed with which the player achieves selected ones of the game's objectives such as passing cars, jumping over barrels, the number of zombies killed or the player's success in matching words or symbols, for example. Many other methods of determining player skill may be devised, with many being game specific. For instance, the regulated gaming machine may count the number of bullets fired before a zombie is killed. In this case, it may be assumed that a more skilled player will expend less ammunition in killing a zombie than a comparatively less experienced player who, instead of a single head shot, may expend multiple rounds to bring the zombie down. According to one embodiment, the player's interactions with the provided in-game assets may be observed and recorded for a sufficient amount of time and/or for a selected portion of the game, to enable it to accurately gauge the player's skill level. As shown at 1006, after having observed the player's apparent skill level, the player rewards and/or the skill level required to achieve at least some of the game's objectives may be changed, to achieve a desired outcome.

The desired outcome may include, according to one embodiment, increasing the player's rewards. Such rewards may be increased, for example, for a player of very low skill, such that he or she does not become discouraged, to help the player advance through the game's script and/or to ensure that the RTP of the game being played does not drop below a required minimum RTP. The desired outcome may also include, according to one embodiment, to encourage and further reward highly-skilled players. Such players may "earn" higher rewards by virtue of their demonstrated skill in the game. These higher rewards, in turn, may also tend to keep such highly-skilled players playing the game longer. Their demonstrated virtuosity may also attract other players to the game, to the casino's benefit.

According to one embodiment, after determining whether sufficient player input has been received and/or whether sufficient game play has occurred for the regulated gaming machine to determine a skill level of the player, the determined skill level may be compared to a first predetermined threshold skill level and to a second predetermined threshold skill level. For example, if skill level were to be normalized on a 0 to 100 scale, a low-skilled player may be determined to have a skill level of 25 or less, a player of average skill a skill level of 26 to 74 and a highly-skilled player a skill level of 75 or above. In that case, the first predetermined threshold skill level may be set at 25 and the second predetermined skill level may be set at 75. According to one implementation, when the when the determined skill level is less than the second predetermined threshold skill level (25 in this case), a first animation may be displayed on a display of the regulated gaming machine and a first change (increase, in this case) may be made to the rewards due to the player for achieving in-game objectives, for at least a portion of remaining game play. This will increase the rewards due to a particularly low-skilled player, to enable the player to complete the game without undue frustrations, to encourage the player to continue playing and/or to ensure that the RTP of the game is at least as great as the required minimum RTP for the jurisdiction in which the regulated gaming machine operates. This first animation may be implemented, for example, as shown at 1108 in FIG. 10. Reference 1008 is a spinning wheel having delineated pizza-shaped sections thereof labeled with player rewards. The first animation, however, may take most any form, but preferably should be informative and engaging for the player. In FIG. 10, the wheel is spun, and the pointer indicates the reward as the pointer settles within one of the delineated pizza-shaped sections. As shown in FIG. 10, the player's reward is 300 player credits (or some other thing of value), either awarded on the spot, or when the player later interacts with the corresponding star symbol. This amount of 300 is increased from its nominal value of 250, as shown in the wheel at 1010, which shows the rewards for a player of average skill level. Each or selected ones of the rewards in the wheel 1008 is increased, as compared to the wheel at 1008. These increased rewards may help the player complete the game without undue frustrations, may encourage the player to continue playing and/or may ensure that the RTP of the game is at least as great as the required minimum RTP. Alternatively, player rewards for low-skilled players may be increased, but not to the same level as the rewards earned by average-skilled players. This is the purview of the game designer and innumerable possibilities exist. The rewards to the player need not be player credits or points, but may include multipliers (as shown), and/or extra time in the game, additional scenes in the game's script and/or extra abilities to enable the low-skilled player to complete at least some of the game's objectives.

As shown also shown in FIG. 10, when the determined skill level is at least as great as a second predetermined threshold skill level (e.g., 75 in the example being developed herewith), a second animation 1010 may be displayed on the display of the regulated gaming machine and a second change may be made to rewards due to the player for achieving in-game objectives for at least a portion of remaining game play. This determined level of skill may identify a highly skilled player, which the game designers wish to further reward. Indeed, it is likely that such a player has developed his or her skill over many games and increased rewards may further encourage such a player to continue playing the game, lest he or she leave money on the table or fail to take advantage of the increased rewards. As shown at 1010, the animation may include a wheel comprising delineated sections labeled with still further increased rewards (in one embodiment, a greater increase than granted to a comparatively lower skilled player). As shown, therefore, whereas the star section at which the wheel 1008 is stopped rewards the player with a star worth 300, the wheel 1010 rewards its player with a star worth 400. In fairness, it is to be expected that the RTP of the game played by a player of lower skill will be lower than the same game played by a player of comparatively higher level of skill. As noted above, the animations need not be of spinning wheels, but could be any entertaining animation including, for example, scene vignettes, engaging music, sounds effects and/or haptic feedback.

Figure 11:
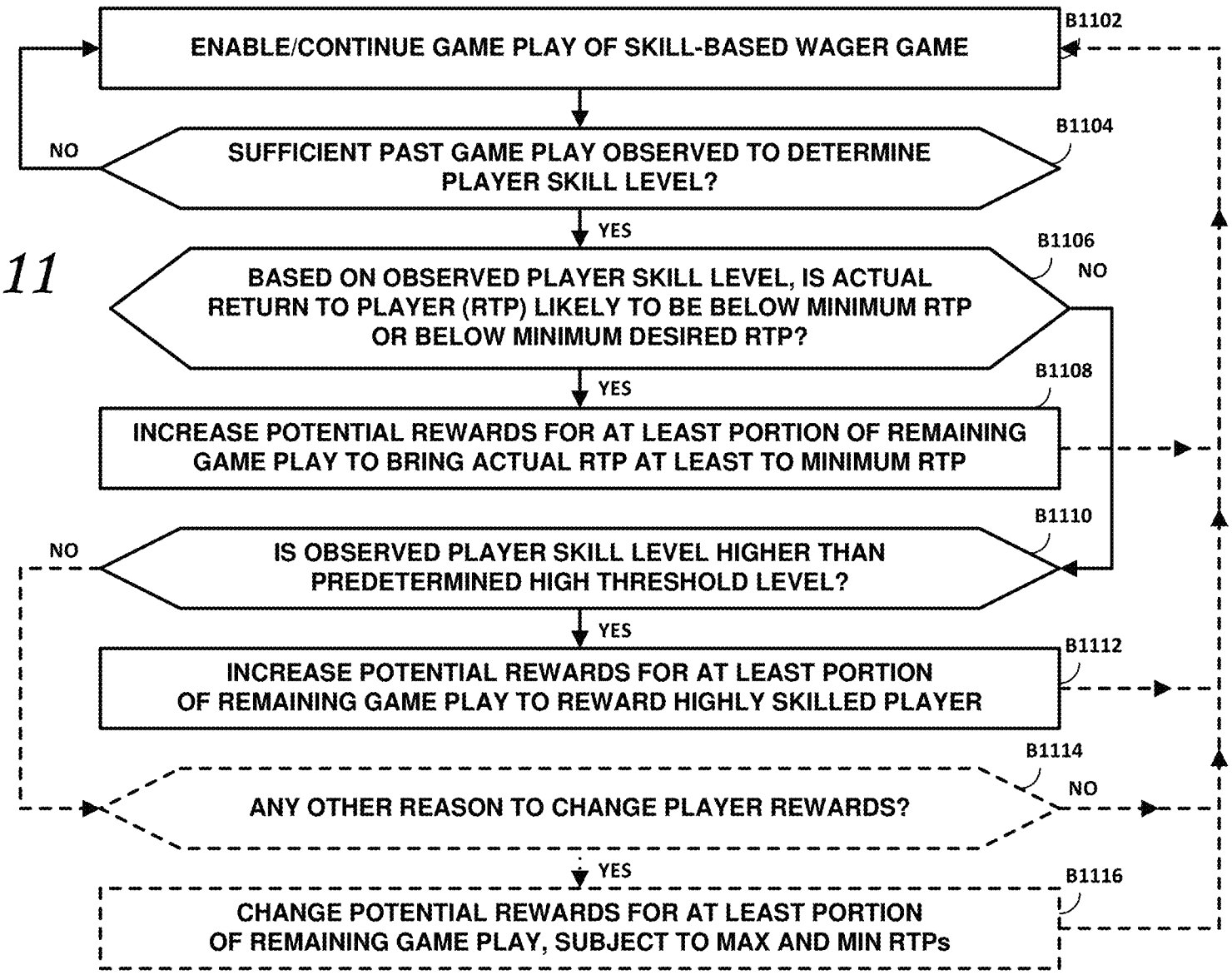
FIG. 11 is a flowchart of a computer-implemented method configured to reward players based upon observed skill level, according to one embodiment.

FIG. 11 is a flowchart of a computer-implemented method configured to reward players based upon observed skill level, according to one embodiment. As shown therein, B1102 calls for enabling game play of a skill-based wager game. Such enabling may be occasioned by, for example, the player inputting funds (coins, paper bills or any form of electronic money) into the regulated gaming machine. If already enabled, game play may continue. At B1104, it may be determined if sufficient past game play has been observed to enable a determination of the player's skill level. If not, the method may revert to B1102. If a determination of the player's skill has been made in B1105, it may be determined in B1106 whether, based on the observed skill level, the player's rewards should be changed. This may be carried out, for example, by determining whether the actual RTP of this game is likely to be below the required minimum RTP or below some other desired RTP or whether the player experience may be heightened by increasing his or her rewards. If the actual RTP of the game is likely to come in below the required or desired minimum (YES branch of B1106), some engaging animation and/or music or sound effect may be played and the potential (or already realized) rewards for at least a portion of remaining game play may be increased, to bring the RTP of the game at or above the required or desired minimum RTP, as shown at B1108, whereupon the method may revert to B1102 for continued game play. If, however, the actual RTP of the game is likely to come in above or at the required or desired minimum (NO branch of B1106), the computer-implemented method may proceed to B1110, in which it may be determined whether the observed player skill level is higher than some predetermined high threshold level, which would be indicative of a highly-skilled player. If so (YES branch of B1110), some engaging animation and/or music or sound effect may be played and the actual or potential rewards due to the player may be increased for at least a portion of the remaining game play, as indicated at B1112. The method may then revert to B1102 for continued game play. Instead of RTP, the measure may be perceived player experience or any other objective or subjective measure.

If, as shown in FIG. 11, the observed player level is not below the minimum RTP, below the minimum desired RTP and is not higher than the predetermined high threshold level, block B1114 may be optionally carried out. This is the case in which the observed skill level is indicative of a player of average skill—neither too low or too high. For such determined skill levels, the rewards due may be left unchanged. Alternatively, if there is another reason to change them (YES branch of B1114), the potential or actual rewards due to the player may be changed as desired as shown at B1116, after suitable animation and subject to required or desired minimum RTP and subject to a maximum desired RTP and/or subject to the Unacceptably High Payback Rule. The other reason to change the player rewards may include the desire to assert a more fine-grained control over the RTP, a special promotion and/or any legitimate other reason the casino operator or game designer may desire to tweak the rewards due to players for successful interactions with the available in-game assets. If there are no other reasons to change the player rewards (NO branchy of B1114), the game may revert to B1102, to enable continued game play until the player credits run out or the player cashes out.

Figure 12:
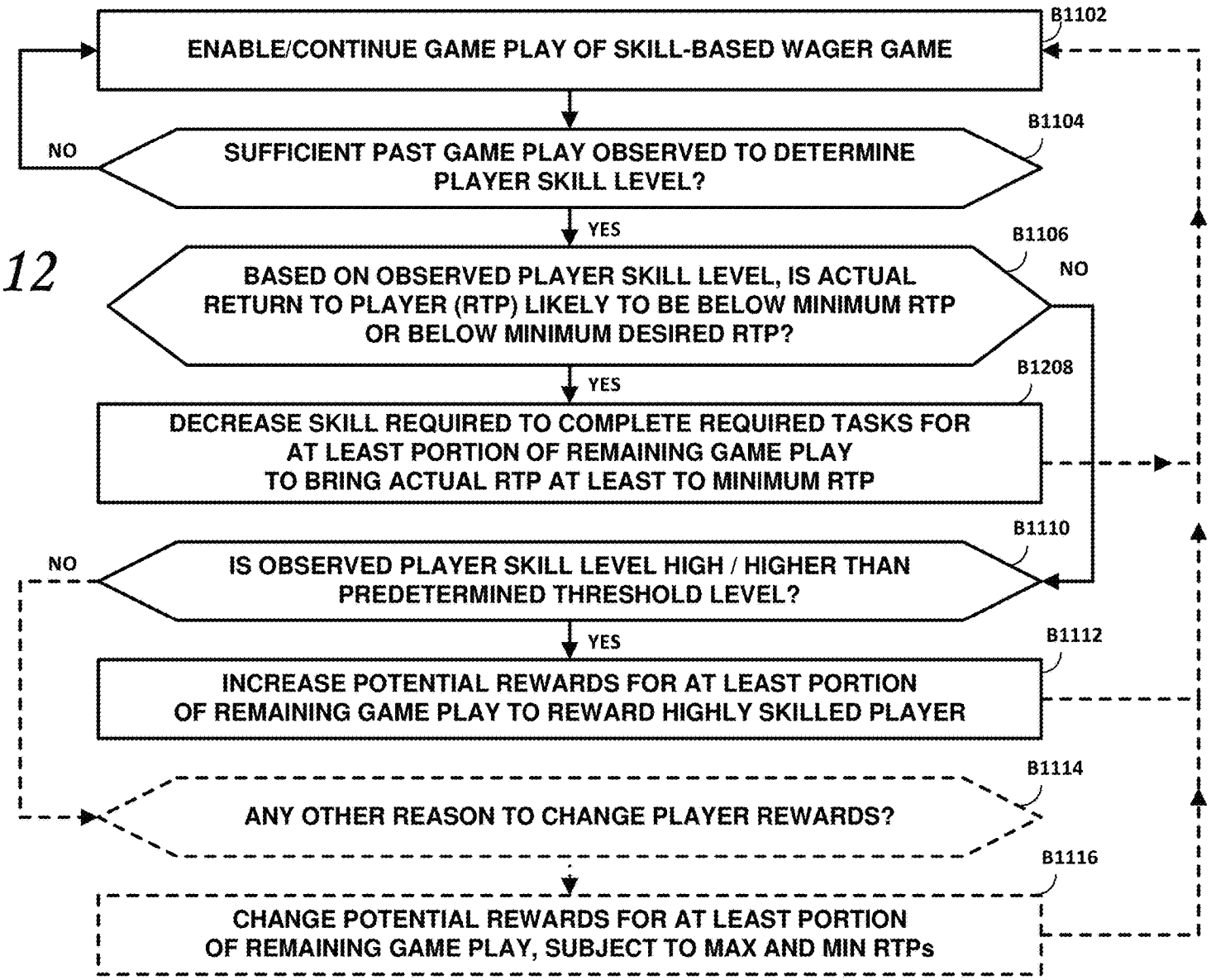
FIG. 12 is a flowchart of a computer-implemented method configured to reward players based upon observed skill level, according to another embodiment.

FIG. 12 is a flowchart of a computer-implemented method configured to reward players based upon observed skill level, according to another embodiment. Instead of increasing the rewards due to the player when the observed skill level falls below a required or desired minimum as shown at B1108 in FIG. 11, the skill required to complete one or more required in-game tasks may be decreased as shown at B1208 in FIG. 2, for at least a portion of remaining game play, to bring the RTP of the game up to the required minimum or desired RTP and/or to provide the desired player experience. Blocks B1108 and B1208 may be used alternatively, sequentially or together to increase the rewards to a low-performing player. Other methods may also be used in conjunction with blocks B1108, B1208 and B1112 to achieve the stated objectives.

Figure 13:
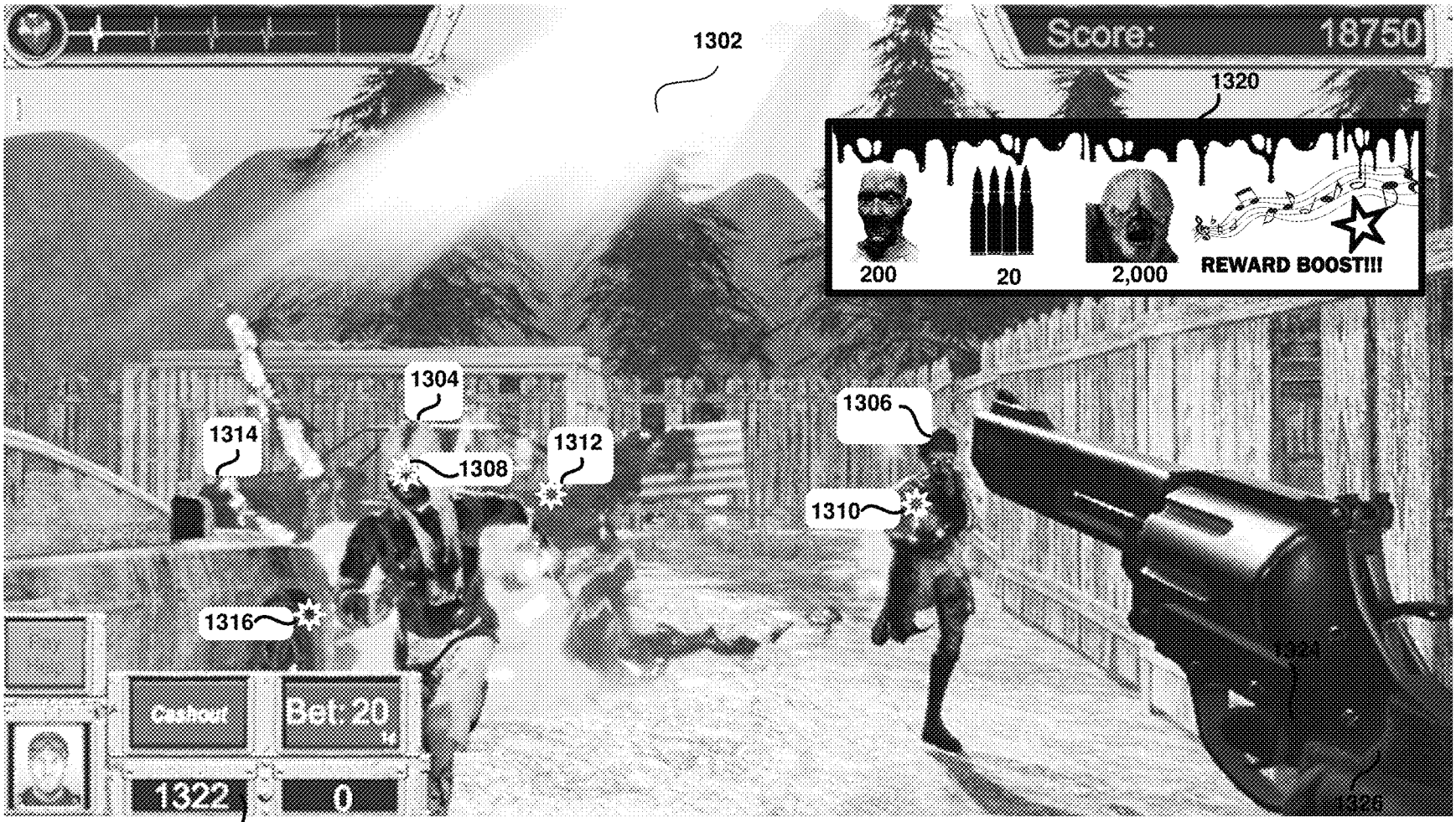
FIG. 13 is a representation of an exemplary scene of skillful wagering side game configured to reward players based upon observed skill level, according to another embodiment.

FIG. 13 shows a representation of a scene 1302 from a game configured according to one embodiment. As shown, the game is a first-person shooter in which one objective is to shoot and kill attacking zombies. In this game, the in-game assets include zombies, but may also include other enemies or items to be avoided, blown up, disabled, collected and/or interacted with in another manner. One or more of these enabled in-game assets may be configured as wagering opportunities when interacted with by a player of the regulated wager-based gaming machine. As shown in FIG. 13, the player more or less skillfully interacts with the game via a virtual weapon and/or some physical input device shaped as a weapon (a revolver in this case). Herein, a successful player interaction may be defined as one in which the player shoots and kills (and/or permanently incapacitates) the zombie and an unsuccessful interaction may be defined as one in which the player either misses the zombie or merely injures or degrades the imminent danger posed by the rampaging undead in question. A successful interaction, in this implementation, may give rise to a wagering event, for which the player may be randomly rewarded. In this exemplary game, a zombie can only be killed by a shot to the head.

FIG. 13 shows three in-game assets; namely two zombies 1304 and 1306 and one automobile 1314, which are the player's targets in this scene. The player interacts with the zombies 1304 and 1306 by attempting to shoot them, with the impacts of the shots being shown at 1308 and 1310. A shot to the automobile in-game asset is also shown at 1312. As shown, 1310 is not a zombie kill shot, being to the chest. 1308 is a zombie kill shot, being to the head of zombie 1304. In this implementation, shot 1308 is considered to be a successful interaction with the zombie in-game asset 1304, giving rise to a wagering event and a corresponding random award to the player. Shot 1312 may also be considered to be a successful interaction with the automobile in-game asset 1314, as it is perfectly placed to ignite the fuel tank. Shot 1316 missed zombie 1204 and chest shot 1310 to zombie 1306 would be considered to unsuccessful player interactions that would not, in one embodiment, give rise to a wager or a wagering event. Likewise, shots to the zombies' limbs would be ineffective in killing the zombies and would, in this implementation, also be considered to be unsuccessful interactions that would not give rise to wagers. In another implementation, such non-lethal but zombie-injuring shots may themselves give rise to a wager and a random determination of an award, but with the game utilizing other paytables that may be less-advantageous to the player than the paytable or paytables accessed in the aftermath of a precisely-placed kill shot.

FIG. 13 shows a scene of a game in a skill-based regulated gaming machine configured to enable wagers to be made and money or player credits to be awarded as a function of the outcome of such wagers. Therefore, such a regulated gaming machine, according to one embodiment, may be configured to accept funds from a player (either cash or some form of electronic money or value) and to correspondingly establish player game credits, as shown at 1318. According to one embodiment, the game may comprise a plurality of enabled in-game assets (e.g., zombies and a car, in the scene shown in FIG. 13). After having accepted the player's funds, the regulated gamine machine may then enable game play and receive player input from a user interface of the regulated gaming machine and the displayed revolver shown in FIG. 13 as the player interacts (shoots) with in-game assets (zombies, cars, etc.). After determining that sufficient player input has been received and/or that sufficient game play has occurred, the regulated gaming machine may then determine the player's skill level by whatever means makes sense in the context of the game being played. The determined skill level may be compared to, for example, a first predetermined threshold skill level and a second predetermined threshold skill level. When, according to one embodiment, the determined skill level is less than the first predetermined threshold skill level, a first animation may be provided on a display of the regulated gaming machine and a first change may be made to rewards due to the player for achieving in-game objectives, for at least a portion of remaining game play. Similarly, when the determined skill level is at least as great as the second predetermined threshold skill level, a second animation may be provided on the display of the regulated gaming machine and a second change to rewards due to the player for achieving in-game objectives may be made, for at least a portion of remaining game play. One such animation and change is shown in FIG. 13 at 1320. Reference 1320 shows a "Reward Boost" in a separate window, animated with dripping blood, informing the player that his or her rewards for successfully interacting with the selected displayed in-game assets have been increased from their previous values to the values shown in the window 1320. That is, killing a zombie may now be worth 200, each shot fired may be worth 20 and killing the boss monster may be worth 2,000. Music or sound effects may accompany this animation, as shown. In this manner, low-skilled players will be incentivized to continue playing and highly-skilled players will be rewarded for their skillful prowess in the game.

It is to be noted that, instead or in addition to increasing the rewards due to the player for successfully interacting with selected in-game assets, other ways of increasing the RTP and/or player experience may be employed. For example, for low-skilled players, the zombies may be made to move slower, making them easier to kill. Additional ammunition may be provided, or the availability of targets (in-game assets available for player interaction) may be increased. Any other way of boosting low-skilled players and rewarding highly skilled ones may be used in conjunction with the described and shown embodiments.

Figure 14:
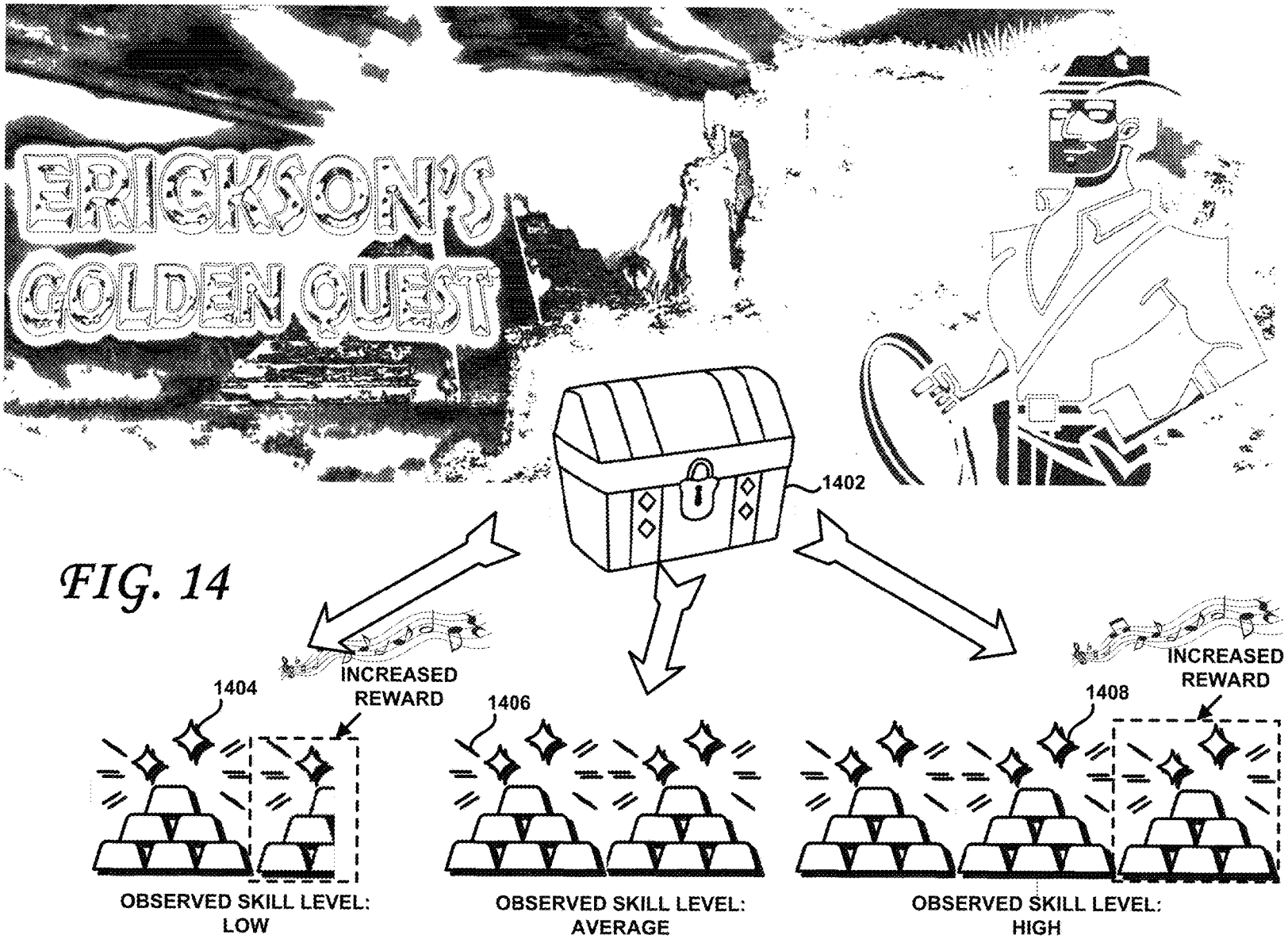
FIG. 14 is a representation of another exemplary scene of skillful wagering side game configured to reward players based upon observed skill level, according to another embodiment.

FIG. 14 shows yet another implementation of an embodiment. As shown therein, a skill and wager-based adventure game called "Erickson's Golden Quest" is being played in a regulated gaming machine. One of the objects of the game, for purposes of the present disclosure only, is to find and open a treasure chest, shown at 1402. In this game, a player of average skill may open the treasure chest 1402 and find two piles of gold bars, as shown at 1406. A player determined to have a low level of skill (however defined) would have found only one pile of gold bars in the chest. However, such an amount of gold may not result in the player earning a sufficient return according to local regulations or may not be a sufficient amount of gold to complete later stages of the game. Therefore, according to one embodiment, the reward due to such a low-skilled player may be increased—sufficiently to bring the game's RTP at or above the minimum, or at or above a desired RTP or at or above a minimum deemed necessary for the player to enjoy his or her game play. In the example shown in FIG. 14, the reward due to the low-skilled player has been increased by one-half of a stack of gold. On the other hand, a highly-skilled player may have earned two stacks of gold and that amount may have been increased, due to his or her determined high skill level, by another stack of gold, as shown at 1408. Other implementations are possible.

Therefore, one embodiment is a computer-implemented method of operating a regulated gaming machine, comprising: accepting funds, in the regulated gaming machine, from a player and correspondingly establishing player game credits enabling the player to play a wager-based skillful game; enabling game play and receiving player input from a user interface of the regulated gaming machine as the player interacts with in-game assets; determining whether sufficient player input has been received and game play has occurred for the regulated gaming machine to determine a skill level of the player; when sufficient game play has occurred, determining the skill level of the player, comparing the determined skill level to at least a first predetermined threshold skill level and a second predetermined threshold skill level; when the determined skill level is less than the first predetermined threshold skill level, displaying a first animation on a display of the regulated gaming machine and making a first change to rewards due to the player for achieving in-game objectives, for at least a portion of remaining game play; and when the determined skill level is at least as great as the second predetermined threshold skill level, displaying a second animation on the display of the regulated gaming machine and making a second change to rewards due to the player for achieving in-game objectives for at least a portion of remaining game play.

According to further embodiments, when the determined skill level is less than the first predetermined threshold skill level, making the first change to rewards due to the player may comprise selecting one or more in-game assets and increasing a reward due to the player for successfully interacting with the selected in-game asset(s). When the determined skill level is at least as great as the second predetermined threshold skill level, making the second change to rewards due to the player may comprise selecting one or more in-game asset and increasing a reward due to the player for successfully interacting with the selected in-game asset(s). The first and/or second changes may include increases to the rewards due to the player for achieving in-game objectives. The first change may increase the rewards due to the player for achieving the in-game objectives such that the RTP of the game is at least as great as a minimum required or desired RTP. To encourage continued game play by skillful players, the second change may increase the rewards due to the player for achieving the in-game objectives more than the first increase. The first and/or second changes may comprise increasing multipliers, increasing points earned, increasing time allotted, changing a script of the game and/or changing a skill level required for a successful interaction with at least a selected one of the in-game assets, for example. Other ways of doing this may also be used. The first change may increase the rewards due to the player by reducing a skill required to successfully interact with at least a selected one of the in-game assets. The first and/or second animation may comprise spinning a wheel having a plurality of sections, each corresponding to an increased reward to the player for successfully interacting with one or more selected in-game assets. The first and/or second animation may comprise, for example, opening a treasure chest to reveal increased rewards to the player for successfully interacting with at least a selected one of the in-game assets.

Figure 15:
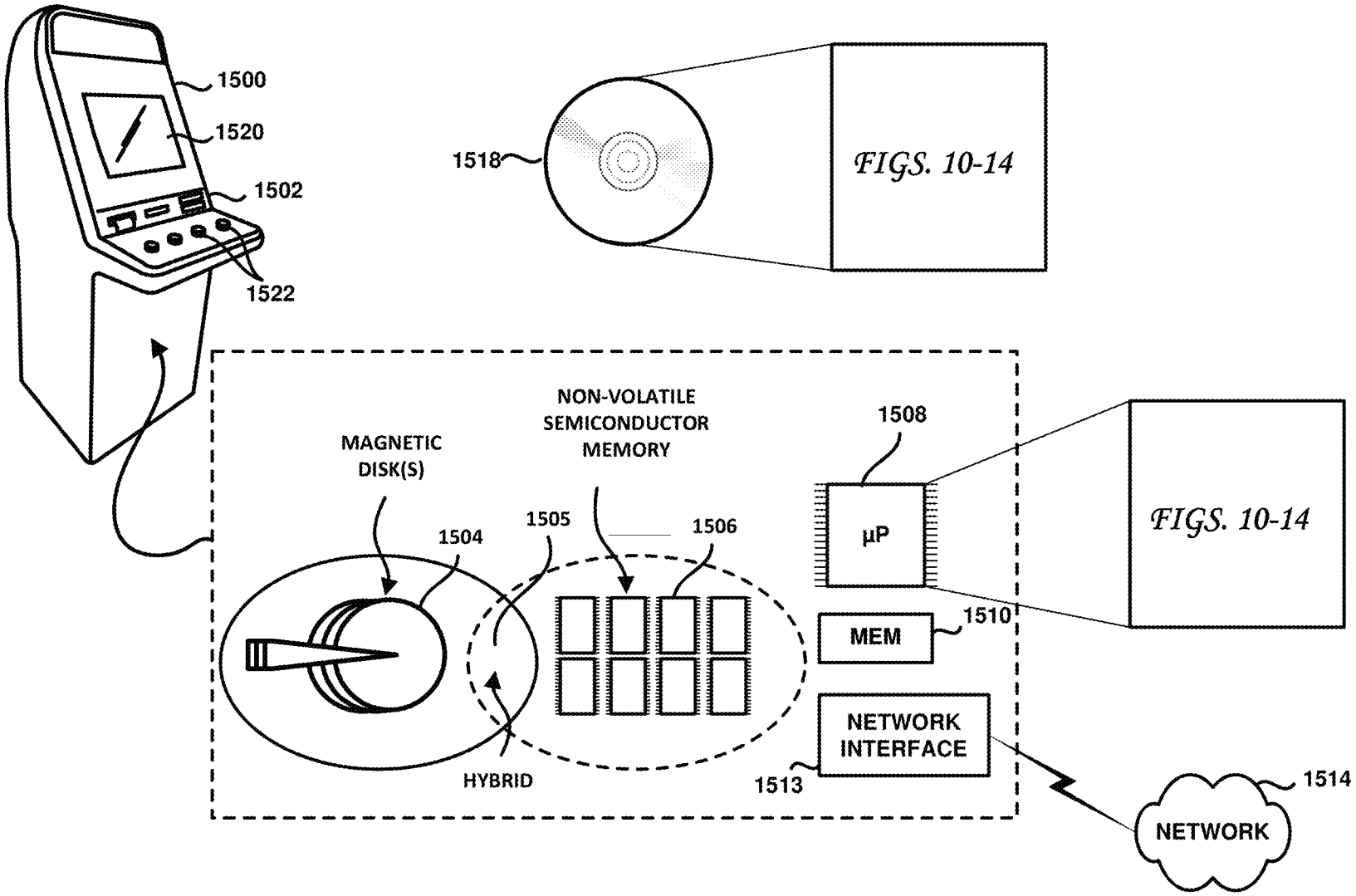
FIG. 15 shows a wager-based regulated gaming machine configured according to embodiments.

Another embodiment is an electronic, wager-based gaming device, such as shown in FIG. 2 at 251 and in FIG. 15 at 1500. Such a wager-based gaming device may comprise a memory; at least one processor; a display; a user interface; and a plurality of processes spawned by the processor. According to one embodiment, the plurality of processes may comprise processing logic to accept funds, in the regulated gaming machine, from a player and correspondingly establish player game credits enabling the player to play a wager-based skillful game. The electronic, wager-based gaming device may then enable game play and receiving player input from a user interface of the regulated gaming machine as the player interacts with in-game assets and determine whether sufficient player input has been received and game play has occurred for the regulated gaming machine to determine a skill level of the player. When sufficient game play has occurred, the skill level of the player may be determined and compared to at least a first predetermined threshold skill level and a second predetermined threshold skill level. When the determined skill level is less than the first predetermined threshold skill level, the processing logic may cause a first animation to be displayed on a display of the regulated gaming machine and make a first change to rewards due to the player for achieving in-game objectives, for at least a portion of remaining game play. When the determined skill level is at least as great as the second predetermined threshold skill level, the processing logic may cause the display of a second animation on a display of the regulated gaming machine and may make a second change to rewards due to the player for achieving in-game objectives for at least a portion of remaining game play.

Another embodiment is a tangible, non-transitory computer-readable medium as shown at 1518. This tangible, non-transitory computer-readable medium may have data stored thereon representing sequences of instructions which, when executed by a regulated gaming computing device, cause the regulated gaming to carry out the above shown and described method. Examples of such tangible, non-transitory computer-readable media are shown at references 1518, 1504, 1505, 1506 and 1510 and elsewhere in the figures.

Yet another embodiment is a method of providing a game for a regulated gaming machine that comprises providing an existing console-type game or arcade-type game and modifying the provided game to operate on the regulated gaming machine such that the regulated gaming machine:

- accepts funds from a player and correspondingly establishes player game credits enabling the player to play a wager-based version of the existing skill-based console-type game or arcade-type game;
- enables game play and receives player input from a user interface of the regulated gaming machine as the player interacts with in-game assets of the game;
- determines whether sufficient player input has been received and game play has occurred for the regulated gaming machine to determine a skill level of the player;
- when sufficient game play has occurred, compares the determined skill level to at least a first predetermined threshold skill level and a second predetermined threshold skill level;
- when the determined skill level is less than the first predetermined threshold skill level, displays a first animation on a display thereof and makes a first change to rewards due to the player for achieving in-game objectives, for at least a portion of remaining game play; and
- when the determined skill level at least as great as the second predetermined threshold skill level, displays a second animation on the display thereof machine and makes a second change to rewards due to the player for achieving in-game objectives for at least a portion of remaining game play FIG. 15 shows a wager-based regulated gaming machine configured according to embodiments. According to one embodiment, an electronic, wager-based gaming device 1502 may comprise a memory 1504, 1505, 1506, 1510, at least one processor 1508, a display 1520 and a user interface 1522. A plurality of processes may be spawned by the processor, which plurality of processes may comprise processing logic to carry out the functionality shown and described relative to FIGS. 10-14. FIG. 15 also shows exemplary tangible, non-transitory computer-readable media 1518, 1504, 1505 or 1506 having data stored thereon representing sequences of instructions which, when executed by the regulated gaming computing device, cause the regulated gaming computing device to determine rewards due to a player playing a wager-based game according to embodiments.

Discussing now FIG. 15 in greater detail, reference number 1502 is a regulated gaming machine, also referenced herein as an electronic gaming device (EGD) and electronic gaming machine (EGM). The regulated gaming machine 1502 may comprise direct access data storage devices such as magnetic disks 1504, non-volatile semiconductor memories (EEPROM, Flash, etc.) 1506, a hybrid data storage device 1505 comprising both magnetic disks 1504 and non-volatile semiconductor memories, one or more microprocessors 1508 and volatile memory 1510. The regulated gaming machine 1502 may also comprise a network interface 1513, configured to communicate over network 1514 with remote servers, storage services and the like. References 1504, 1505 and 1506 are examples of tangible, non-transitory computer-readable media having data stored thereon representing sequences of instructions which, when executed by a regulated gaming computing device, cause the regulated gaming computing device to provide wager-based games and determine rewards due to a player playing such wager-based game as described and shown herein, particularly at FIGS. 10-14. Some of these instructions may be stored locally in the gaming machine 1502, while others of these instructions may be stored (and/or executed) remotely and communicated to the gaming machine 1502 over the network 1514. In other embodiments, all these instructions may be stored locally in the gaming machine 1502, while in still other embodiments, all of these instructions are stored and executed remotely, based on payer interactions at the gaming machine 1502, and the results communicated to the gaming machine 1502. In another embodiment, the instructions may be stored on another form of a tangible, non-transitory computer readable medium, such as shown at 1518. For example, reference 1518 may be implemented as an optical disk, which may constitute a suitable data carrier to load the instructions stored thereon onto the gaming machine 1502, thereby re-configuring the gaming machine to one or more of the embodiments described and shown herein. In other implementations, reference 1518 may be embodied as an encrypted persistent memory such as a Flash drive. Other implementations are possible.

In the foregoing description, numerous specific details are set forth in order to provide a thorough understanding of one or more aspects and/or features of the exemplary embodiments. It will be apparent to one skilled in the art, however, that one or more aspects and/or features described herein may be omitted in favor of others or omitted all together. In some instances, the description of well-known process steps and/or structures are omitted for clarity or for the sake of brevity.

Herein, devices or processes that are described as being in communication with each other need not be in continuous communication with each other, unless expressly specified otherwise. In addition, devices or processes that are disclosed to be in communication with one another may communicate directly or indirectly through one or more intermediaries.

Further, although constituent steps of methods have been described in a sequential order, such methods may be configured to work in alternate orders. In other words, any sequence or order of steps that may be described herein does not, in and of itself, indicate a requirement that the steps be performed in that order. The steps of described processes may be performed in an order that differs from the order described herein. Further, some steps may be performed simultaneously despite being described or implied as occurring non-simultaneously (e.g., because one step is described after the other step). Moreover, the illustration of a process by its depiction in a drawing does not imply that the illustrated process is exclusive of other variations and modifications thereto, does not imply that the illustrated process or any of its steps are necessary to one or more of the invention(s), and does not imply that the illustrated process is preferred over other processes.

When a single device or article is described, it will be readily apparent that more than one device/article (e.g., whether or not they cooperate) may be used in place of a single device/article. Similarly, where more than one device or article is described (e.g., whether or not they cooperate), it will be readily apparent that a single device/article may be used in place of the more than one device or article. The functionality and/or the features of a device may be alternatively embodied by one or more other devices that are not explicitly described as having such functionality/features.

Lastly, while certain embodiments of the disclosure have been described, these embodiments have been presented by way of example only and are not intended to limit the scope of the disclosure. Indeed, the novel methods, devices and systems described herein may be embodied in a variety of other forms. Furthermore, various omissions, substitutions and changes in the form of the methods and systems described herein may be made without departing from the spirit of the disclosure. The accompanying claims and their equivalents are intended to cover such forms or modifications as would fall within the scope and spirit of the disclosure. For example, those skilled in the art will appreciate that in various embodiments, the actual physical and logical structures may differ from those shown in the figures. Depending on the embodiment, certain steps described in the example above may be removed, others may be added. Also, the features and attributes of the specific embodiments disclosed above may be combined in different ways to form additional embodiments, all of which fall within the scope of the present disclosure. Although the present disclosure provides certain preferred embodiments and applications, other embodiments that are apparent to those of ordinary skill in the art, including embodiments which do not provide all the features and advantages set forth herein, are also within the scope of this disclosure. Accordingly, the scope of the present disclosure is intended to be defined only by reference to the appended claims.

The invention claimed is:

1. A computer-implemented method of operating a regulated gaming machine, comprising:

accepting funds, in the regulated gaming machine, from a player and correspondingly establishing player game credits enabling the player to play a wager-based skillful game;

enabling game play and receiving player input from a user interface of the regulated gaming machine as the player interacts with in-game assets;

determining whether sufficient player input has been received and game play has occurred for the regulated gaming machine to determine a skill level of the player;

when sufficient game play has occurred, determining the skill level of the player, comparing the determined skill level to at least a first predetermined threshold skill level and a second predetermined threshold skill level;

when the determined skill level is less than the first predetermined threshold skill level, displaying a first animation on a display of the regulated gaming machine and making a first change to increase a time allotted to play the wager-based skillful game; and when the determined skill level is at least as great as the second predetermined threshold skill level, displaying a second animation on the display of the regulated gaming machine and making a second change to increase a time allotted to play the wager-based skillful game.

2. The computer-implemented method of operating a regulated gaming machine of claim 1, wherein when the determined skill level is at least as great as the first predetermined threshold skill level, making the first change further comprises selecting at least one in-game asset and increasing a reward due to the player for successfully interacting with the selected in-game asset.

3. The computer-implemented method of operating a regulated gaming machine of claim 1, wherein when the determined skill level is at least as great as the second predetermined threshold skill level, making the second change further comprises selecting at least one in-game asset and increasing a reward due to the player for successfully interacting with the selected in-game asset.

4. The computer-implemented method of operating a regulated gaming machine of claim 1, wherein at least one of the first and second changes comprises increases to the rewards due to the player for achieving in-game objectives.

5. The computer-implemented method of operating a regulated gaming machine of claim 1, wherein the first change comprises increasing the rewards due to the player for achieving the in-game objectives such that a Return to Player (RTP) of the game is at least as great as a minimum RTP.

6. The computer-implemented method of operating a regulated gaming machine of claim 1 wherein the second change comprises increasing the rewards due to the player for achieving the in-game objectives more than the first increase.

7. The computer-implemented method of operating a regulated gaming machine of claim 1, wherein at least one of the first and second changes further comprises at least one of changing a script of the game and changing a skill level required for a successful interaction with at least a selected one of the in-game assets.

8. The computer-implemented method of operating a regulated gaming machine of claim 1, wherein the first change further comprises increasing the rewards due to the player by reducing a skill required to successfully interact with at least a selected one of the in-game assets.

9. The computer-implemented method of operating a regulated gaming machine of claim 1, wherein at least one of the first and second animation comprises spinning a wheel having a plurality of sections each corresponding to an increased reward to the player for successfully interacting with at least a selected one of the in-game assets.

10. The computer-implemented method of operating a regulated gaming machine of claim 1, wherein at least one of the first and second animation comprises opening a treasure chest to reveal increased rewards to the player for successfully interacting with at least a selected one of the in-game assets.

11. An electronic, wager-based gaming device, comprising:

a memory;

at least one processor;

a display;

a user interface; and a plurality of processes spawned by the processor, the plurality of processes comprising processing logic to:

accept funds, in the regulated gaming machine, from a player and correspondingly establish player game credits enabling the player to play a wager-based skillful game;

enable game play and receiving player input from a user interface of the regulated gaming machine as the player interacts with in-game assets;

determine whether sufficient player input has been received and game play has occurred for the regulated gaming machine to determine a skill level of the player;

when sufficient game play has occurred, determining the skill level of the player, compare the determined skill level to at least a first predetermined threshold skill level and a second predetermined threshold skill level;

when the determined skill level is less than the first predetermined threshold skill level, display a first animation on a display of the regulated gaming machine and make a first change to increase a time allotted to play the wager-based skillful game; and when the determined skill level is at least as great as the second predetermined threshold skill level, display a second animation on the display of the regulated gaming machine and make a second change to increase a time allotted to play the wager-based skillful game.

12. The electronic, wager-based gaming device of claim 11, wherein the plurality of processes further comprise processing logic to, when the determined skill level is at least as great as the first predetermined threshold skill level, further configure the first change to select at least one in-game asset and increase a reward due to the player for successfully interacting with the selected in-game asset.

13. The electronic, wager-based gaming device of claim 11, wherein the plurality of processes further comprise processing logic to, when the determined skill level is at least as great as the second predetermined threshold skill level, further configure the second change to select at least one in-game asset and increase a reward due to the player for successfully interacting with the selected in-game asset.

14. The electronic, wager-based gaming device of claim 11, wherein at least one of the first and second changes further comprise increases to the rewards due to the player for achieving in-game objectives.

15. The electronic, wager-based gaming device of claim 11, wherein the first change is further configured to increase the rewards due to the player for achieving the in-game objectives such that a Return to Player (RTP) of the game is at least as great as a minimum RTP.

16. The electronic, wager-based gaming device of claim 11 wherein the second change is further configured to increase the rewards due to the player for achieving the in-game objectives more than the first increase.

17. The electronic, wager-based gaming device of claim 11, wherein at least one of the first and second changes further comprises at least one of changing a script of the game and changing a skill level required for a successful interaction with at least a selected one of the in-game assets.

18. The electronic, wager-based gaming device of claim 11, wherein the first change is further configured to increase the rewards due to the player by reducing a skill required to successfully interact with at least a selected one of the in-game assets.

19. The electronic, wager-based gaming device of claim 11, wherein at least one of the first and second animation comprises spinning a wheel having a plurality of sections each corresponding to an increased reward to the player for successfully interacting with at least a selected one of the in-game assets.

20. The electronic, wager-based gaming device of claim 11, wherein at least one of the first and second animation comprises opening a treasure chest to reveal increased rewards to the player for successfully interacting with at least a selected one of the in-game assets.

21. A tangible, non-transitory computer-readable medium having data stored thereon representing sequences of instructions which, when executed by a regulated gaming computing device, cause the regulated gaming to carry out a method, comprising:

accepting funds, in the regulated gaming machine, from a player and correspondingly establishing player game credits enabling the player to play a wager-based skillful game;

enabling game play and receiving player input from a user interface of the regulated gaming machine as the player interacts with in-game assets;

determining whether sufficient player input has been received and game play has occurred for the regulated gaming machine to determine a skill level of the player;

when sufficient game play has occurred, determining the skill level of the player, comparing the determined skill level to at least a first predetermined threshold skill level and a second predetermined threshold skill level;

when the determined skill level is less than the first predetermined threshold skill level, displaying a first animation on a display of the regulated gaming machine and making a first change to increase a time allotted to play the wager-based skillful game; and when the determined skill level is at least as great as the second predetermined threshold skill level, displaying a second animation on the display of the regulated gaming machine and making a second change to increase a time allotted to play the wager-based skillful game.

22. A method of providing a game for a regulated gaming machine, comprising:

providing an existing skill-based console-type game or arcade-type game;

modifying the provided game to operate on the regulated gaming machine such that:

the regulated gaming machine accepts funds from a player and correspondingly establishes player game credits enabling the player to play a wager-based version of the existing skill-based console-type game or arcade-type game;

the regulated gaming machine enables game play and receives player input from a user interface of the regulated gaming machine as the player interacts with in-game assets of the game;

the regulated gaming machine determines whether sufficient player input has been received and game play has occurred for the regulated gaming machine to determine a skill level of the player;

when sufficient game play has occurred, the regulated gaming machine determines the skill level of the player, compares the determined skill level to at least a first predetermined threshold skill level and a second predetermined threshold skill level;

when the determined skill level is less than the first predetermined threshold skill level, the regulated gaming machine displays a first animation on a display thereof and makes a first change to increase a time allotted to play the wager-based skillful game; and when the determined skill level is at least as great as the second predetermined threshold skill level, the regulated gaming machine displays a second animation on the display thereof machine and makes a second change to increase a time allotted to play the wager-based skillful game.

23. A computer-implemented method of operating a gaming machine, comprising:

accepting funds, in the regulated gaming machine, from a player and correspondingly establishing player game credits enabling the player to play a wager-based skillful game;

enabling game play and receiving player input from a user interface of the regulated gaming machine as the player interacts with in-game assets;

determining whether sufficient player input has been received and game play has occurred for the regulated gaming machine to determine a skill level of the player;

when sufficient game play has occurred, determining the skill level of the player, comparing the determined skill level to at least a first predetermined threshold skill level and a second predetermined threshold skill level;

when the determined skill level is less than the first predetermined threshold skill level, displaying a first animation on a display of the regulated gaming machine and making a first change to a script of the wager-based skillful game; and when the determined skill level is at least as great as the second predetermined threshold skill level, displaying a second animation on the display of the regulated gaming machine and making a second change to the script of the wager-based skillful game.

24. An electronic, wager-based gaming device, comprising:

a memory;

at least one processor;

a display;

a user interface; and a plurality of processes spawned by the processor, the plurality of processes comprising processing logic to:

accept funds, in the regulated gaming machine, from a player and correspondingly establish player game credits enabling the player to play a wager-based skillful game;

enable game play and receiving player input from a user interface of the regulated gaming machine as the player interacts with in-game assets;

determine whether sufficient player input has been received and game play has occurred for the regulated gaming machine to determine a skill level of the player;

when sufficient game play has occurred, determining the skill level of the player, compare the determined skill level to at least a first predetermined threshold skill level and a second predetermined threshold skill level;

when the determined skill level is less than the first predetermined threshold skill level, display a first animation on a display of the regulated gaming machine and make a first change to a script of the wager-based skillful game; and when the determined skill level is at least as great as the second predetermined threshold skill level, display a second animation on the display of the regulated gaming machine and make a second change to the script of the wager-based skillful game.

25. A computer-implemented method of operating a gaming machine, comprising:

accepting funds, in the regulated gaming machine, from a player and correspondingly establishing player game credits enabling the player to play a wager-based skillful game;

enabling game play and receiving player input from a user interface of the regulated gaming machine as the player interacts with in-game assets;

determining whether sufficient player input has been received and game play has occurred for the regulated gaming machine to determine a skill level of the player;

when sufficient game play has occurred, determining the skill level of the player, comparing the determined skill level to at least a first predetermined threshold skill level and a second predetermined threshold skill level;

when the determined skill level is less than the first predetermined threshold skill level, displaying a first animation on a display of the regulated gaming machine and changing a skill level required for a successful interaction with a first selected at least one of the in-game assets; and when the determined skill level is at least as great as the second predetermined threshold skill level, displaying a second animation on the display of the regulated gaming machine and changing a skill level required for a successful interaction with a second selected at least one of the in-game assets.

26. An electronic, wager-based gaming device, comprising:

a memory;

at least one processor;

a display;

a user interface; and a plurality of processes spawned by the processor, the plurality of processes comprising processing logic to:

accept funds, in the regulated gaming machine, from a player and correspondingly establish player game credits enabling the player to play a wager-based skillful game;

enable game play and receiving player input from a user interface of the regulated gaming machine as the player interacts with in-game assets;

determine whether sufficient player input has been received and game play has occurred for the regulated gaming machine to determine a skill level of the player;

when sufficient game play has occurred, determining the skill level of the player, compare the determined skill level to at least a first predetermined threshold skill level and a second predetermined threshold skill level;

when the determined skill level is less than the first predetermined threshold skill level, display a first animation on a display of the regulated gaming machine and change a skill level required for a successful interaction with a first selected at least one of the in-game assets; and when the determined skill level is at least as great as the second predetermined threshold skill level, display a second animation on the display of the regulated gaming machine and change a skill level required for a successful interaction with a second selected at least one of the in-game assets.

27. A computer-implemented method of operating a gaming machine, comprising:

accepting funds, in the regulated gaming machine, from a player and correspondingly establishing player game credits enabling the player to play a wager-based skillful game;

enabling game play and receiving player input from a user interface of the regulated gaming machine as the player interacts with in-game assets;

determining whether sufficient player input has been received and game play has occurred for the regulated gaming machine to determine a skill level of the player;

when sufficient game play has occurred, determining the skill level of the player, comparing the determined skill level to at least a first predetermined threshold skill level and a second predetermined threshold skill level;

when the determined skill level is less than the first predetermined threshold skill level, displaying a first animation on a display of the regulated gaming machine and making a first change to rewards due to the player for achieving in-game objectives, for at least a portion of remaining game play; and when the determined skill level is at least as great as the second predetermined threshold skill level, displaying a second animation on the display of the regulated gaming machine and making a second change to rewards due to the player for achieving in-game objectives, for at least a portion of remaining game play, wherein at least one of the first and second animations comprises opening a treasure chest to reveal increased rewards to the player for successfully interacting with a selected at least one of the in-game assets.

28. An electronic, wager-based gaming device, comprising:

a memory;

at least one processor;

a display;

a user interface; and a plurality of processes spawned by the processor, the plurality of processes comprising processing logic to:

accept funds, in the regulated gaming machine, from a player and correspondingly establish player game credits enabling the player to play a wager-based skillful game;

enable game play and receiving player input from a user interface of the regulated gaming machine as the player interacts with in-game assets;

determine whether sufficient player input has been received and game play has occurred for the regulated gaming machine to determine a skill level of the player;

when sufficient game play has occurred, determining the skill level of the player, compare the determined skill level to at least a first predetermined threshold skill level and a second predetermined threshold skill level;

when the determined skill level is less than the first predetermined threshold skill level, display a first animation on a display of the regulated gaming machine and make a first change to rewards due to the player for achieving in-game objectives, for at least a portion of remaining game play; and when the determined skill level is at least as great as the second predetermined threshold skill level, display a second animation on the display of the regulated gaming machine and make a second change to rewards due to the player for achieving in-game objectives, for at least a portion of remaining game play, wherein at least one of the first and second animations comprises opening a treasure chest to reveal increased rewards to the player for successfully interacting with a selected at least one of the in-game assets.

* * * * *